US006140293A

United States Patent [19]

Lappas

[11] Patent Number: 6,140,293

[45] **Date of Patent: *Oct. 31, 2000**

[54] DETERGENT COMPOSITIONS COMPRISING A SPECIFIC AMYLASE AND A PROTEASE

[75] Inventor: Dimitris Lappas, Strombeek-Bever, Belgium

[73] Assignee: The Procter & Gamble Company, Cincinnati, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 09/000,285

[22] PCT Filed: Jul. 24, 1996

[86] PCT No.: PCT/US96/12144

§ 371 Date: Jan. 26, 1998

§ 102(e) Date: Jan. 26, 1998

[87] PCT Pub. No.: WO97/04054

PCT Pub. Date: Feb. 6, 1997

[30] Foreign Application Priority Data

Jun. 19, 1996 [EP] European Pat. Off. ..... 96201705
May 8, 1997 [JP] Japan ..... 9-118349

[51] Int. Cl.[7] ..... C11D 3/385

[52] U.S. Cl. ..... 510/305; 510/226; 510/236; 510/320; 510/321; 510/374; 510/580

[58] Field of Search ..... 510/226, 236, 510/305, 320, 321, 374, 392, 530

[56] References Cited

U.S. PATENT DOCUMENTS

| | | | |
|---|---|---|---|
| 3,627,688 | 12/1971 | McCarty | 252/153 |
| 3,936,537 | 2/1976 | Baskerville, Jr. | 427/242 |
| 4,011,169 | 3/1977 | Diehl | 252/95 |
| 4,264,466 | 4/1981 | Carleton | 252/99 |
| 4,285,841 | 8/1981 | Barrat | 252/559 |
| 4,287,082 | 9/1981 | Tolfo | 252/174.12 |
| 4,308,151 | 12/1981 | Cambre | 252/8.8 |
| 4,470,919 | 9/1984 | Goffinet | 252/102 |
| 4,483,781 | 11/1984 | Hartman | 252/174.12 |
| 4,489,455 | 12/1984 | Spendel | 8/158 |
| 4,561,998 | 12/1985 | Wertz | 252/547 |
| 4,747,977 | 5/1988 | Whitehead | 252/111 |
| 4,767,557 | 8/1988 | Herdeman | 252/91 |
| 4,810,413 | 3/1989 | Pancheri | 252/174.12 |
| 5,275,753 | 1/1994 | de Buzzaccarini | 252/95 |
| 5,354,491 | 10/1994 | Bjorkquist | 252/135 |
| 5,422,030 | 6/1995 | Panandiker | 252/135 |
| 5,501,820 | 3/1996 | van den Bergh | 252/549 |
| 5,520,838 | 5/1996 | Baeck et al. | 252/174.12 |
| 5,534,179 | 7/1996 | Miracle et al. | 510/305 |
| 5,559,089 | 9/1996 | Hartman et al. | 510/224 |
| 5,578,136 | 11/1996 | Taylor et al. | 139/25.2 |
| 5,595,967 | 1/1997 | Miracle | 510/372 |
| 5,654,421 | 8/1997 | Taylor et al. | 540/351 |
| 5,707,950 | 1/1998 | Kasturi et al. | 510/320 |
| 5,731,280 | 3/1998 | Nielsen et al. | 510/392 |
| 5,736,385 | 7/1998 | Bott et al. | 510/392 |
| 5,753,460 | 5/1998 | Bisgård-Frantzen et al. | 435/691 |
| 5,763,499 | 6/1998 | Mitchinson et al. | 510/392 |
| 5,803,986 | 9/1998 | Baeck et al. | 134/25.2 |
| 5,804,542 | 9/1998 | Scheper et al. | 510/221 |

FOREIGN PATENT DOCUMENTS

| | | | |
|---|---|---|---|
| 94/02597 | 2/1994 | WIPO . | |
| WO 94/02597 | 2/1994 | WIPO | C12N 9/28 |
| WO 94/18314 | 8/1994 | WIPO | C12N 9/28 |
| WO 95/10603 | 4/1995 | WIPO | C12N 9/28 |

*Primary Examiner*—Kery Fries
*Attorney, Agent, or Firm*—C. Brant Cook; Kim W. Zerby; Jacobus C. Rasser

[57] ABSTRACT

The present invention relates to detergent compositions comprising an oxidative stability-enhanced amylase and a protease at a level from 0.0001% to 0.5%, preferably from 0.001% to 0.2%, more preferably from 0.005% to 0.1% pure protease enzyme by weight of total composition. Such compositions provide improved cleaning and stains removal performances.

1 Claim, No Drawings

DETERGENT COMPOSITIONS COMPRISING A SPECIFIC AMYLASE AND A PROTEASE

TECHNICAL FIELD

The present invention relates to detergent compositions comprising an oxidative stability-enhanced amylase and a specific level of protease, which improve cleaning and stain removal performances in hard surface cleaning, dishwashing and laundry.

BACKGROUND OF THE INVENTION

It is common commercial practice to include amylases in detergent compositions to enhance cleaning performance.

Indeed, amylase enzymes have long been recognised in dishwashing, hard surface cleaning and laundry compositions to provide the removal of starchy food residues or starchy films from dishware, flatware, glasses and hard surfaces or to provide cleaning performance on starchy soils as well as other soils typically encountered in laundry applications.

WO94/02597, Novo Nordisk A/S published Feb. 3, 1994, describes cleaning compositions which incorporate mutant amylases. See also WO/94/18314, Genencor, published Aug. 18, 1994 and WO/95/10603, Novo Nordisk A/S, published Apr. 20, 1995. Other amylases known for use in cleaning compositions include both α- and β-amylases. α-Amylases are known in the art and include those disclosed in U.S. Pat. No. 5,003,257; EP 252,666; WO/91/00353; FR 2,676,456; EP 285,123; EP 525,610; EP 368,341; and British Patent specification no. 1,296,839 (Novo).

Moreover, proteases are commonly used in detergent composition were high sudsing and/or good insoluble substrate removal are desired. Indeed, their ability to hydrolyse proteins has been taken advantage of by incorporating naturally occuring and protein engineered proteases as an additive to hard surfaces cleaners, dishwashing compositions, laundry compositions and the like. Many stains are proteinaceous and wide-specificity proteases can substantially improve removal of such stains.

Therefore, while amylase is known to act on starch stains, there remains a substantial technical challenge in formulating detergent compositions comprising amylase and protease in such a manner to meet the consumer's need for superior cleaning performance on soils and in particular, starchy soils.

It is an object of the present invention to provide detergent compositions including laundry, dishwashing and hard surface cleaner, containing oxidative stability-enhanced amylases and specific proteases.

It is a further objective to formulate laundry detergent compositions which provide effective and efficient surface cleaning of textile, particularly on dingy stains.

It has now surprisingly been found that specific proteases at a level from 0.0001% to 0.5%, preferably from 0.001% to 0.2%, more preferably from 0.005% to 0.1% pure enzyme by weight of total composition provide a performance boosting function for the amylase enzyme. It is indeed believed that the enzymatic hydrolysis of the starch enhance the release of the proteinaceous compounds while the hydrolysis of the intertangled proteins stains helps the release of the starch components.

These benefits may allow either improved performance or a reduction of the detergent actives levels without associated performance loss.

SUMMARY OF THE INVENTION

It is an object of the present invention to provide detergent compositions comprising an oxidative stability-enhanced amylase and a protease at a level from 0.0001% to 0.5%, preferably from 0.001% to 0.2, more preferably from 0.005% to 0.1% pure protease enzyme by weight of total composition.

DETAILED DESCRIPTION OF THE INVENTION

Oxidative Stability-enhanced Amylase

An essential component of the detergent compositions of the present invention is a "oxidative stability-enhanced" amylase selected from:

(a) stability-enhanced amylases including Purafact Ox Am$^R$ described in WO 94/18314 and WO96/05295. Therein it was noted that improved oxidative stability amylases have been made by Genencor from B.licheniformis NCIB8061. Methionine (Met) was indentified as the most likely residue to be modifiefed. Met was substitued, one at a time, in positions 8, 15, 197, 256, 304, 366 and 438 leading to specific mutants, particularly important being M197L and M197T with the M197T variant being the most stable expressed variant. Also preferred is the variant modified at TRP 138 residue such as W138Y;

(b) amylase variants having additional modification in the immediate parent available from Novo Nordisk A/S. These amylases disclosed in WO 95/10603, published April 95, are known by the Tradename Duramyl®.

Said oxidative stability-enhanced amylase are comprised in the detergent formulations of the present invention at a level of 0.0001% to 0.1%, preferably from 0.0002% to 0.06%, more preferably from 0.0003% to 0.05% pure enzyme by weight of total composition.

The detergent compositions of the present invention when formulated as laundry composition, provide effective and efficient fabric cleaning, particularly on dingy stains. Dingy stains are found typically on pillow cases, T-shirts and sock bottom. They are thought to be the result of a combination of fatty soils: lipids, proteins, pigments, with particulate soils: airborn soil and ground dust.

Without wishing to be bound by any theory, It is believed that carbohydrates and especially high molecular weight starches adhere to fabrics and bind other hydrophilic soils and especially proteinaceous soils components such as milk, blood or other proteins contained in food or common soils, to the fabric hampering their removal. Enzymatic hydrolysis of the starch help release the proteinaceous soil components while hydrolysis of the intertangled proteins stains helps the removal of starchy components.

Proteolytic Enzymes

The proteolytic enzymes are incorporated in the detergent compositions of the present invention a level of from 0.0001% to 0.5%, preferably from 0.001% to 0.2%, more preferably from 0.005% to 0.1% pure enzyme by weight of the composition.

The proteolytic enzyme can be of animal, vegetable or microorganism (preferred) origin. More preferred is serine proteolytic enzyme of bacterial origin. Purified or non purified forms of this enzyme may be used. Proteolytic enzymes produced by chemically or genetically modified mutants are included by definition, as are close structural enzyme variants.

Suitable proteases are the subtilisins which are obtained from particular strains of *B. subtilis* and *B. licheniformis* (subtilisin BPN and BPN'). One suitable protease is obtained from a strain of Bacillus, having maximum activity throughout the pH range of 8–12, developed and sold as ESPERASE® by Novo Industries A/S of Denmark, hereinafter "Novo". The preparation of this enzyme and analogous enzymes is described in GB 1,243,784 to Novo. Other suitable proteases include ALCALASE®, DURAZYM® and SAVINASE® from Novo and MAXATASE®, MAXACAL®, PROPERASE® and MAXAPEM® (protein engineered Maxacal) from International Bio-Synthetics, Inc., The Netherlands; as well as Protease A as disclosed in EP 130,756 A, Jan. 9, 1985 and Protease B as disclosed in EP 303,761 A, Apr. 28, 1987 and EP 130,756 A, Jan. 9, 1985. See also a high pH protease from Bacillus sp. NCIMB 40338 described in WO 93/18140 A to Novo. Enzymatic detergents comprising protease, one or more other enzymes, and a reversible protease inhibitor are described in WO 92/03529 A to Novo. Other preferred proteases include those of WO 95/10591 A to Procter & Gamble. When desired, a protease having decreased adsorption and increased hydrolysis is available as described in WO 95/07791 to Procter & Gamble. A recombinant trypsin-like protease for detergents suitable herein is described in WO 94/25583 to Novo.

In more detail, protease referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76, preferably also in combination with one or more amino acid residue positions equivalent to those selected from the group consisting of +99, +101, +103, +104, +107, +123, +27, +105, +109, +126, +128, +135, +156, +166, +195, +195 +204, +206, +210, +216, +217, +218, +222, +260, +265, and/or +274 according to the numbering of *Bacillus amyloliquefaciens* subtilisin, as described in WO95/10591 and in the patent application of C. Ghosh, et al, "Bleaching Compositions Comprising Protease Enzymes" having U.S. Ser. No. 08/322,677, filed Oct. 13, 1994. Also suitable for the present invention are proteases described in patent applications EP 251 446 and WO91/06637.

Preferred protease for use in the present invention are SAVINASE® and the proteases described in EP 215 446 and WO95/10591 at a level of from 0.001% to 0.5%, preferably from 0.003% to 0.2%, more preferably from 0.01% to 0.1% pure enzyme by weight of total composition for liquid detergent compositions and; SAVINASE®, ALCALASE® and the proteases described in WO91/06637 and WO95/10591 at a level of from 0.0001% to 0.2% , preferably from 0.001% to 0.1%, more preferably 0.005% to 0.05% pure enzyme by weight of total composition in granular detergent compositions.

A range of enzyme materials and means for their incorporation into synthetic detergent compositions is also disclosed in WO 93/07263 A and WO 93/07260 A to Genencor International, WO 89/08694 A to Novo, and U.S. Pat. No. 3,553,139, Jan. 5, 1971 to McCarty et al. Enzymes are further disclosed in U.S. Pat. No. 4,101,457, Place et al, Jul. 18, 1978, and in U.S. Pat. No. 4,507,219, Hughes, Mar. 26, 1985. Enzyme materials useful for liquid detergent formulations, and their incorporation into such formulations, are disclosed in U.S. Pat. No. 4,261,868, Hora et al, Apr. 14, 1981. Enzymes for use in detergents can be stabilised by various techniques. Enzyme stabilisation techniques are disclosed and exemplified in U.S. Pat. No. 3,600,319, Aug. 17, 1971, Gedge et al, EP 199,405 and EP 200,586, Oct. 29, 1986, Venegas. Enzyme stabilisation systems are also described, for example, in U.S. Pat. No. 3,519,570. A useful Bacillus, sp. AC13 giving proteases, xylanases and cellulases, is described in WO 94/01532 A to Novo.

Detergent Components

The detergent compositions of the invention may also contain additional detergent components. The precise nature of these additional components, and levels of incorporation thereof will depend on the physical form of the composition, and the nature of the cleaning operation for which it is to be used.

The detergent compositions according to the invention can be liquid, paste, gels, bars, tablets, powder or granular forms. Granular compositions can also be in "compact" form, the liquid compositions can also be in a "concentrated" form.

The compositions of the invention may for example, be formulated as hard surface cleaner, hand and machine dishwashing compositions, hand and machine laundry detergent compositions including laundry additive compositions and compositions suitable for use in the soaking and/or pretreatment of stained fabrics, rinse added fabric softener compositions.

When formulated as compositions for use in manual dishwashing methods the compositions of the invention preferably contain a surfactant and preferably other detergent compounds selected from organic polymeric compounds, suds enhancing agents, group II metal ions, solvents, hydrotropes and additional enzymes.

When formulated as compositions suitable for use in a laundry machine washing method, the compositions of the invention preferably contain both a surfactant and a builder compound and additionally one or more detergent components preferably selected from organic polymeric compounds, bleaching agents, additional enzymes, suds suppressors, dispersants, lime-soap dispersants, soil suspension and anti-redeposition agents and corrosion inhibitors. Laundry compositions can also contain softening agents, as additional detergent components.

The compositions of the invention can also be used as detergent additive products. Such additive products are intended to supplement or boost the performance of conventional detergent compositions.

If needed the density of the granular laundry detergent compositions herein ranges from 400 to 1200 g/litre, preferably 600 to 950 g/litre of composition measured at 20° C.

The "compact" form of the granular laundry detergent compositions herein is best reflected by density and, in terms of composition, by the amount of inorganic filler salt; inorganic filler salts are conventional ingredients of detergent compositions in powder form; in conventional detergent compositions, the filler salts are present in substantial amounts, typically 17–35% by weight of the total composition.

In the compact compositions, the filler salt is present in amounts not exceeding 15% of the total composition, preferably not exceeding 10%, most preferably not exceeding 5% by weight of the composition.

The inorganic filler salts, such as meant in the present compositions are selected from the alkali and alkaline-earth-metal salts of sulphates and chlorides.

A preferred filler salt is sodium sulphate.

Liquid detergent compositions according to the present invention can also be in a "concentrated form", in such case, the liquid detergent compositions according the present invention will contain a lower amount of water, compared to conventional liquid detergents.

Typically the water content of the concentrated liquid detergent is preferably less than 50%, more preferably less than 40%, most preferably less than 30% by weight of the detergent composition.

Surfactant System

The detergent compositions according to the present invention comprise a surfactant system wherein the surfactant can be selected from nonionic and/or anionic and/or cationic and/or ampholytic and/or zwitterionic and/or semipolar surfactants.

The surfactant is typically present at a level of from 0.1% to 60% by weight. More preferred levels of incorporation are 1% to 35% by weight, most preferably from 1% to 20% by weight of laundry and rinse added fabric softener compositions in accord with the invention.

The surfactant is preferably formulated to be compatible with enzyme components present in the composition. In liquid or gel compositions the surfactant is most preferably formulated such that it promotes, or at least does not degrade, the stability of any enzyme in these compositions.

Preferred surfactant systems to be used according to the present invention comprise as a surfactant one or more of the nonionic and/or anionic surfactants described herein.

Polyethylene, polypropylene, and polybytylene oxide condensates of alkyl phenols are suitable for use as the nonionic surfactant of the surfactant systems of the present invention, with the polyethylene oxide condensates being preferred. These compounds include the condensation products of alkyl phenols having an alkyl group containing from about 6 to about 14 carbon atoms, preferably from about 8 to about 14 carbon atoms, in either a straight-chain or branched-chain configuration with the alkylene oxide. In a preferred embodiment, the ethylene oxide is present in an amount equal to from about 2 to about 25 moles, more preferably from about 3 to about 15 moles, of ethylene oxide per mole of alkyl phenol. Commercially available nonionic surfactants of this type include Igepal™ CO-630, marketed by the GAF Corporation; and Triton™ X-45, X-114, X-100 and X-102, all marketed by the Rohm & Haas Company. These surfactants are commonly referred to as alkylphenol alkoxylates (e.g., alkyl phenol ethoxylates).

The condensation products of primary and secondary aliphatic alcohols with from about 1 to about 25 moles of ethylene oxide are suitable for use as the nonionic surfactant of the nonionic surfactant systems of the present invention. The alkyl chain of the aliphatic alcohol can either be straight or branched, primary or secondary, and generally contains from about 8 to about 22 carbon atoms. Preferred are the condensation products of alcohols having an alkyl group containing from about 8 to about 20 carbon atoms, more preferably from about 10 to about 18 carbon atoms, with from about 2 to about 10 moles of ethylene oxide per mole of alcohol. About 2 to about 7 moles of ethylene oxide and most preferably from 2 to 5 moles of ethylene oxide per mole of alcohol are present in said condensation products. Examples of commercially available nonionic surfactants of this type include Tergitol™ 15-S-9 (the condensation product of $C_{11}$–$C_{15}$ linear alcohol with 9 moles ethylene oxide), Tergitol™ 24-L-6 NMW (the condensation product of $C_{12}$–$C_{14}$ primary alcohol with 6 moles ethylene oxide with a narrow molecular weight distribution), both marketed by Union Carbide Corporation; Neodol™ 45-9 (the condensation product of $C_{14}$–$C_{15}$ linear alcohol with 9 moles of ethylene oxide), Neodol™ 23-3 (the condensation product of $C_{12}$–$C_{13}$ linear alcohol with 3.0 moles of ethylene oxide), Neodol™ 45-7 (the condensation product of $C_{14}$–$C_{15}$ linear alcohol with 7 moles of ethylene oxide), Neodol™ 45-5 (the condensation product of $C_{14}$–$C_{15}$ linear alcohol with 5 moles of ethylene oxide) marketed by Shell Chemical Company, Kyro™ EOB (the condensation product of $C_{13}$–$C_{15}$ alcohol with 9 moles ethylene oxide), marketed by The Procter & Gamble Company, and Genapol LA O3O or O5O (the condensation product of $C_{12}$–$C_{14}$ alcohol with 3 or 5 moles of ethylene oxide) marketed by Hoechst. Preferred range of HLB in these products is from 8–11 and most preferred from 8–10.

Also useful as the nonionic surfactant of the surfactant systems of the present invention are the alkylpolysaccharides disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g. a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties (optionally the hydrophobic group is attached at the 2-, 3-, 4-, etc. positions thus giving a glucose or galactose as opposed to a glucoside or galactoside). The intersaccharide bonds can be, e.g., between the one position of the additional saccharide units and the 2-, 3-, 4-, and/or 6-positions on the preceding saccharide units.

The preferred alkylpolyglycosides have the formula $$R^2O(C_nH_{2n}O)_t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from about 10 to about 18, preferably from about 12 to about 14, carbon atoms; n is 2 or 3, preferably 2; t is from 0 to about 10, preferably 0; and x is from about 1.3 to about 10, preferably from about 1.3 to about 3, most preferably from about 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominately the 2-position.

The condensation products of ethylene oxide with a hydrophobic base formed by the condensation of propylene oxide with propylene glycol are also suitable for use as the additional nonionic surfactant systems of the present invention. The hydrophobic portion of these compounds will preferably have a molecular weight of from about 1500 to about 1800 and will exhibit water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially-available Pluronic™ surfactants, marketed by BASF.

Also suitable for use as the nonionic surfactant of the nonionic surfactant system of the present invention, are the condensation products of ethylene oxide with the product resulting from the reaction of propylene oxide and ethylenediamine. The hydrophobic moiety of these products consists of the reaction product of ethylenediamine and excess propylene oxide, and generally has a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic™ compounds, marketed by BASF.

Preferred for use as the nonionic surfactant of the surfactant systems of the present invention are polyethylene oxide condensates of alkyl phenols, condensation products of primary and secondary aliphatic alcohols with from about 1 to about 25 moles of ethylene oxide, alkylpolysaccharides, and mixtures thereof. Most preferred are $C_8$–$C_{14}$ alkyl phenol ethoxylates having from 3 to 15 ethoxy groups and $C_8$–$C_{18}$ alcohol ethoxylates (preferably $C_1$ avg.) having from 2 to 10 ethoxy groups, and mixtures thereof.

Highly preferred nonionic surfactants are polyhydroxy fatty acid amide surfactants of the formula.

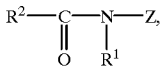

wherein $R^1$ is H, or $R^1$ is $C_{1-4}$ hydrocarbyl, 2-hydroxy ethyl, 2-hydroxy propyl or a mixture thereof, $R^2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R^1$ is methyl, $R^2$ is a straight $C_{11-15}$ alkyl or $C_{16-18}$ alkyl or alkenyl chain such as coconut alkyl or mixtures thereof, and Z is derived from a reducing sugar such as glucose, fructose, maltose, lactose, in a reductive amination reaction.

When included in such detergent compositions, the nonionic surfactant systems of the present invention act to improve the greasy/oily stain removal properties of such detergent compositions across a broad range of conditions.

Suitable anionic surfactants to be used are linear alkyl benzene sulfonate, alkyl ester sulfonate surfactants including linear esters of $C_8$–$C_{20}$ carboxylic acids (i.e., fatty acids) which are sulfonated with gaseous $SO_3$ according to "The Journal of the American Oil Chemists Society", 52 (1975), pp. 323–329. Suitable starting materials would include natural fatty substances as derived from tallow, palm oil, etc. The preferred alkyl ester sulfonate surfactant, especially for laundry applications, comprise alkyl ester sulfonate surfactants of the structural formula:

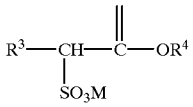

wherein $R^3$ is a $C_8$–$C_{20}$ hydrocarbyl, preferably an alkyl, or combination thereof, $R^4$ is a $C_1$–$C_6$ hydrocarbyl, preferably an alkyl, or combination thereof, and M is a cation which forms a water soluble salt with the alkyl ester sulfonate. Suitable salt-forming cations include metals such as sodium, potassium, and lithium, and substituted or unsubstituted ammonium cations, such as monoethanolamine, diethanolamine, and triethanolamine. Preferably, $R^3$ is $C_{10}$–$C_{16}$ alkyl, and $R^4$ is methyl, ethyl or isopropyl. Especially preferred are the methyl ester sulfonates wherein $R^3$ is $C_{10}$–$C_{16}$ alkyl.

Other suitable anionic surfactants include the alkyl sulfate surfactants which are water soluble salts or acids of the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation, e.g., an alkali metal cation (e.g. sodium, potassium, lithium), or ammonium or substituted ammonium (e.g. methyl-, dimethyl-, and trimethyl ammonium cations and quaternary ammonium cations such as tetramethyl-ammonium and dimethyl piperdinium cations and quaternary ammonium cations derived from alkylamines such as ethylamine, diethylamine, triethylamine, and mixtures thereof, and the like). Typically, alkyl chains of $C_{12}$–$C_{16}$ are preferred for lower wash temperatures (e.g. below about 50° C.) and $C_{16-18}$ alkyl chains are preferred for higher wash temperatures (e.g. above about 50° C.).

Other anionic surfactants useful for detersive purposes can also be included in the detergent compositions of the present invention. These can include salts (including, for example, sodium, potassium, ammonium, and substituted ammonium salts such as mono-, di- and triethanolamine salts) of soap, $C_8$–$C_{22}$ primary of secondary alkanesulfonates, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl glycerol sulfonates, fatty acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinates (especially saturated and unsaturated $C_{12}$–$C_{18}$ monoesters) and diesters of sulfosuccinates (especially saturated and unsaturated $C_6$–$C_{12}$ diesters), acyl sarcosinates, sulfates of alkylpolysaccharides such as the sulfates of alkylpolyglucoside (the nonionic nonsulfated compounds being described below), branched primary alkyl sulfates, and alkyl polyethoxy carboxylates such as those of the formula $RO(CH_2CH_2O)_k$—$CH_2COO$-M+ wherein R is a $C_8$–$C_{22}$ alkyl, k is an integer from 1 to 10, and M is a soluble salt-forming cation. Resin acids and hydrogenated resin acids are also suitable, such as rosin, hydrogenated rosin, and resin acids and hydrogenated resin acids present in or derived from tall oil.

Further examples are described in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23 (herein incorporated by reference). When included therein, the laundry detergent compositions of the present invention typically comprise from about 1% to about 40%, preferably from about 3% to about 20% by weight of such anionic surfactants.

Highly preferred anionic surfactants include alkyl alkoxylated sulfate surfactants hereof are water soluble salts or acids of the formula $RO(A)_mSO3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl, trimethyl-ammonium cations and quaternary ammonium cations such as tetramethyl-ammonium and dimethyl piperdinium cations and those derived from alkylamines such as ethylamine, diethylamine, triethylamine, mixtures thereof, and the like. Exemplary surfactants are $C_{12}$–$C_{18}$ alkyl polyethoxylate (1.0) sulfate ($C_{12}$–$C_{18}$E(1.0)M), $C_{12}$–$C_{18}$ alkyl polyethoxylate (2.25) sulfate ($C_{12}$–$C_{18}$E(2.25)M), $C_{12}$–$C_{18}$ alkyl polyethoxylate (3.0) sulfate ($C_{12}$–$C_{18}$E(3.0)M), and $C_{12}$–$C_{18}$ alkyl polyethoxylate (4.0) sulfate ($C_{12}$–$C_{18}$E(4.0)M), wherein M is conveniently selected from sodium and potassium.

The detergent compositions of the present invention may also contain cationic, ampholytic, zwitterionic, and semi-polar surfactants.

Cationic detersive surfactants suitable for use in the detergent compositions of the present invention are those having one long-chain hydrocarbyl group. Examples of such cationic surfactants include the ammonium surfactants such as alkyltrimethylammonium halogenides, and those surfactants having the formula:

$$[R^2(OR^3)y][R^4(OR^3)y]_2R^5N+X-$$

wherein $R^2$ is an alkyl or alkyl benzyl group having from about 8 to about 18 carbon atoms in the alkyl chain, each $R^3$ is selected from the group consisting of —$CH_2CH_2$—, —$CH_2CH(CH_3)$—, —$CH_2CH(CH_2OH)$—, —$CH_2CH_2CH_2$—, and mixtures thereof; each $R^4$ is selected from the group consisting of $C_1$–$C_4$ alkyl, $C_1$–$C_4$ hydroxyalkyl, benzyl ring structures formed by joining the two $R^4$ groups, —$CH_2CHOH$—$CHOHCOR^6CHOHCH_2OH$ wherein $R^6$ is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Highly preferred cationic surfactants are the water-soluble quaternary ammonium compounds useful in the present composition having the formula:

$$R_1R_2R_3R_4N^+X^- \quad \text{(i)}$$

wherein $R_1$ is $C_8$–$C_1$ alkyl, each of $R_2$, $R_3$ and $R_4$ is independently $C_1$–$C_4$ alkyl, $C_1$–$C_4$ hydroxy alkyl, benzyl, and —$(C_2H_{40})_xH$ where x has a value from 2 to 5, and X is an anion. Not more than one of $R_2$, $R_3$ or $R_4$ should be benzyl. The preferred alkyl chain length for $R_1$ is $C_{12}$–$C_{15}$ particularly where the alkyl group is a mixture of chain lengths derived from coconut or palm kernel fat or is derived synthetically by olefin build up or OXO alcohols synthesis. Preferred groups for $R_2R_3$ and $R_4$ are methyl and hydroxyethyl groups and the anion X may be selected from halide, methosulphate, acetate and phosphate ions. Examples of suitable quaternary ammonium compounds of formulae (i) for use herein are:

- coconut trimethyl ammonium chloride or bromide;
- coconut methyl dihydroxyethyl ammonium chloride or bromide;
- decyl triethyl ammonium chloride;
- decyl dimethyl hydroxyethyl ammonium chloride or bromide;
- $C_{12\text{-}15}$ dimethyl hydroxyethyl ammonium chloride or bromide;
- coconut dimethyl hydroxyethyl ammonium chloride or bromide;
- myristyl trimethyl ammonium methyl sulphate;
- lauryl dimethyl benzyl ammonium chloride or bromide;
- lauryl dimethyl $(ethenoxy)_4$ ammonium chloride or bromide;
- choline esters (compounds of formula (i) wherein $R_1$ is

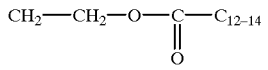

- di-alkyl imidazolines [compounds of formula (i)].

Other cationic surfactants useful herein are also described in U.S. Pat. No. 4,228,044, Cambre, issued Oct. 14, 1980 and in European Patent Application EP 000,224.

Quaternary ammonium surfactant suitable for the present invention has the formula (I):

Formula I

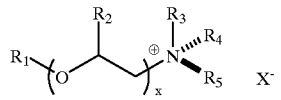

whereby R1 is a short chainlength alkyl (C6–$C_{10}$) or alkylamidoalkyl of the formula (II):

Formula II

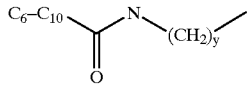

y is 2–4, preferably 3.

whereby R2 is H or a C1–C3 alkyl, whereby x is 0–4, preferably 0–2, most preferably 0, whereby R3, R4 and R5 are either the same or different and can be either a short chain alkyl (C1–C3) or alkoxylated alkyl of the formula III, whereby $X^-$ is a counterion, preferably a halide, e.g. chloride or methylsulfate.

Formula III

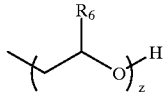

R6 is $C_1$–$C_4$ and z is 1 or 2.

Preferred quat ammonium surfactants are those as defined in formula I whereby $R_1$ is $C_8$, $C_{10}$ or mixtures thereof, x=o, $R_3$, $R_4$=$CH_3$ and $R_5$=$CH_2CH_2OH$.

When included therein, the detergent compositions of the present invention typically comprise from 0.2% to about 25%, preferably from about 1% to about 8% by weight of such cationic surfactants.

Ampholytic surfactants are also suitable for use in the detergent compositions of the present invention. These surfactants can be broadly described as aliphatic derivatives of secondary or tertiary amines, or aliphatic derivatives of heterocyclic secondary and tertiary amines in which the aliphatic radical can be straight- or branched-chain. One of the aliphatic substituents contains at least about 8 carbon atoms, typically from about 8 to about 18 carbon atoms, and at least one contains an anionic water-solubilizing group, e.g. carboxy, sulfonate, sulfate. See U.S. Pat. No. 3,929,678 to Laughlin et al., issued Dec. 30, 1975 at column 19, lines 18–35, for examples of ampholytic surfactants.

When included therein, the detergent compositions of the present invention typically comprise from 0.2% to about 15%, preferably from about 1% to about 10% by weight of such ampholytic surfactants.

Zwitterionic surfactants are also suitable for use in detergent compositions. These surfactants can be broadly described as derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 to Laughlin et al., issued Dec. 30, 1975 at column 19, line 38 through column 22, line 48, for examples of zwitterionic surfactants.

When included therein, the detergent compositions of the present invention typically comprise from 0.2% to about 15%, preferably from about 1% to about 10% by weight of such zwitterionic surfactants.

Semi-polar nonionic surfactants are a special category of nonionic surfactants which include water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to about 18 carbon atoms and a moiety selected from the group consisting of alkyl and hydroxyalkyl moieties of from about 1 to about 3 carbon atoms.

Semi-polar nonionic detergent surfactants include the amine oxide surfactants having the formula

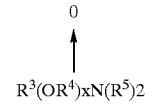

wherein $R^3$ is an alkyl, hydroxyalkyl, or alkyl phenyl group or mixtures therof containing from about 8 to about 22 carbon atoms; $R^4$ is an alkylene or hydroxyalkylene group containing from about 2 to about 3 carbon atoms or mixtures thereof; x is from 0 to about 3; and each $R^5$ is an alkyl or hydroxyalkyl group containing from about 1 to about 3 carbon atoms or a polyethylene oxide group containing from about 1 to about 3 ethylene oxide groups. The $R^5$ groups can be attached to each other, e.g., through an oxygen or nitrogen atom, to form a ring structure.

These amine oxide surfactants in particular include $C_{10}$–$C_{18}$ alkyl dimethyl amine oxides and $C_8$–$C_{12}$ alkoxy ethyl dihydroxy ethyl amine oxides.

When included therein, the detergent compositions of the present invention typically comprise from 0.2% to about 15%, preferably from about 1% to about 10% by weight of such semi-polar nonionic surfactants.

The detergent composition of the present invention may further comprise a cosurfactant selected from the group of primary or tertiary amines.

Suitable primary amines for use herein include amines according to the formula $R_1NH_2$ wherein $R_1$ is a $C_6$–$C_{12}$, preferably $C_6$–$C_{10}$ alkyl chain or $R_4X(CH_2)_n$, X is —O—,—C(O)NH— or —NH—, $R_4$ is a $C_6$–$C_{12}$ alkyl chain n is between 1 to 5, preferably 3. $R_1$ alkyl chains may be straight or branched and may be interrupted with up to 12, preferably less than 5 ethylene oxide moieties.

Preferred amines according to the formula herein above are n-alkyl amines. Suitable amines for use herein may be selected from 1-hexylamine, 1-octylamine, 1-decylamine and laurylamine. Other preferred primary amines include C8–C10 oxypropylamine, octyloxypropylamine, 2-ethylhexyloxypropylamine, lauryl amido propylamine and amido propylamine.

Suitable tertiary amines for use herein include tertiary amines having the formula $R_1R_2R_3N$ wherein R1 and R2 are $C_1$–$C_8$ alkylchains or

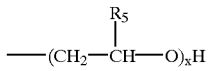

$R_3$ is either a $C_6$–$C_{12}$, preferably $C_6$–$C_{10}$ alkyl chain, or $R_3$ is $R_4X(CH_2)_n$, whereby X is —O—, —C(O)NH— or —NH—, $R_4$ is a $C_4$–$C_{12}$, n is between 1 to 5, preferably 2–3. $R_5$ is H or $C_1$–$C_2$ alkyl and x is between 1 to 6.

$R_3$ and $R_4$ may be linear or branched; $R_3$ alkyl chains may be interrupted with up to 12, preferably less than 5, ethylene oxide moieties.

Preferred tertiary amines are $R_1R_2R_3N$ where R1 is a C6–C12 alkyl chain, R2 and R3 are C1–C3 alkyl or

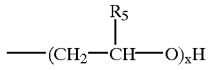

where R5 is H or CH3 and x=1–2.

Also preferred are the amidoamines of the formula:

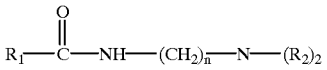

wherein $R_1$ is $C_6$–$C_{12}$ alkyl; n is 2–4, preferably n is 3; $R_2$ and $R_3$ is $C_1$–$C_4$ Most preferred amines of the present invention include 1-octylamine, 1-hexylamine, 1-decylamine, 1-dodecylamine, C8–10oxypropylamine, N coco 1–3 diaminopropane, coconutalkyldimethylamine, lauryldimethylamine, lauryl bis(hydroxyethyl)amine, coca bis(hydroxyehtyl)amine, lauryl amine 2 moles propoxylated, octyl amine 2 moles propoxylated, lauryl amidopropyldimethylamine, C8–10 amidopropyldimethylamine and $C_{10}$ amidopropyldimethylamine. The most preferred amines for use in the compositions herein are 1-hexylamine, 1-octylamine, 1-decylamine, 1-dodecylamine. Especially desirable are n-dodecyldimethylamine and bishydroxyethylcoconutalkylamine and oleylamine 7 times ethoxylated, lauryl amido propylamine and cocoamido propylamine.

Optional Deterrent Ingredients:

Dispersants

Suitable water-soluble organic salts are the homo- or co-polymeric acids or their salts, in which the polycarboxylic acid comprises at least two carboxyl radicals separated from each other by not more than two carbon atoms.

Polymers of this type are disclosed in GB-A-1,596,756. Examples of such salts are polyacrylates of MW 2000–5000 and their copolymers with maleic anhydride, such copolymers having a molecular weight of from 1,000 to 100,000.

Especially, copolymer of acrylate and methylacrylate such as the 480N having a molecular weight of 4000, at a level from 0.5–20% by weight of composition can be added in the detergent compositions of the present invention.

Other Detergent Enzymes

The detergent compositions can in addition to oxidative stability-enhanced amylase and protease enzymes further comprise one or more enzymes which provide cleaning performance and/or fabric care benefits.

Said enzymes include enzymes selected from cellulases, hemicellulases, peroxidases, gluco-amylases, other amylases, xylanases, lipases, esterases, cutinases, pectinases, reductases, oxidases, phenoloxidases, lipoxygenases, ligninases, pullulanases, tannases, pentosanases, malanases, β-glucanases, arabinosidases chondroitinase, laccase or mixtures thereof.

A preferred combination is a cleaning composition having a cocktail of conventional applicable enzymes like protease, amylase, lipase, cutinase and/or cellulase in conjunction with one or more plant cell wall degrading enzymes.

The cellulases usable in the present invention include both bacterial or fungal cellulase. Preferably, they will have a pH optimum of between 5 and 9.5. Suitable cellulases are disclosed in U.S. Pat. No. 4,435,307, Barbesgoard et al, which discloses fungal cellulase produced from Humicola insolens. Suitable cellulases are also disclosed in GB-A-2.075.028; GB-A-2.095.275 and DE-OS-2.247.832.

Examples of such cellulases are cellulases produced by a strain of Humicola insolens (Humicola grisea var. thermoidea), particularly the Humicola strain DSM 1800. Other suitable cellulases are cellulases originated from Humicola insolens having a molecular weight of about 50 KDa, an isoelectric point of 5.5 and containing 415 amino acids. Especially suitable cellulases are the cellulases having color care benefits. Examples of such cellulases are cellulases described in European patent application No. 91202879.2, filed Nov. 6, 1991 (Novo).

Peroxidase enzymes are used in combination with oxygen sources, e.g. percarbonate, perborate, persulfate, hydrogen peroxide, etc. They are used for "solution bleaching", i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromoperoxidase.

Peroxidase-containing detergent compositions are disclosed, for example, in PCT International Application WO 89/099813 and in European Patent application EP No. 91202882.6, filed on Nov. 6, 1991.

Said cellulases and/or peroxidases are normally incorporated in the detergent composition at levels from 0.0001% to 2% of active enzyme by weight of the detergent composition.

Other preferred enzymes that can be included in the detergent compositions of the present invention include lipases. Suitable lipase enzymes for detergent usage include those produced by microorganisms of the Pseudomonas group, such as Pseudomonas stutzeri ATCC 19.154, as disclosed in British Patent 1,372,034. Suitable lipases include those which show a positive immunological cross-reaction with the antibody of the lipase, produced by the microorganism Pseudomonas fluorescent IAM 1057. This lipase is available from Amano Pharmaceutical Co. Ltd., Nagoya, Japan, under the trade name Lipase P "Amano, " hereinafter referred to as "Amano-P". Especially suitable lipases are lipases such as M1 Lipase$^R$ and Lipomax$^R$ (Gist-Brocades) and Lipolase$^R$ and Lipolase Ultra$^R$ (Novo) which have found to be very effective when used in combination with the compositions of the present invention.

Also suitable are cutinases [EC 3.1.1.50] which can be considered as a special kind of lipase, namely lipases which do not require interfacial activation. Suitable cutinases are described in WO 94/14963 and WO 94/14964. Addition of cutinases to detergent compositions have been described in e.g. WO-A-88/09367 (Genencor).

The lipases and/or cutinases are normally incorporated in the detergent composition at levels from 0.0001% to 2% of active enzyme by weight of the detergent composition.

Other amylases (α and/or β) can be included for removal of carbohydrate-based stains. WO/94/02597, Novo Nordisk A/S published Feb. 3, 1994, describes cleaning compositions which incorporate mutant amylases. Other amylases known for use in detergent compositions include both α- and β-amylases. α-Amylases are known in the art and include those disclosed in U.S. Pat. No. 5,003,257; EP 252,666; WO/91/00353; FR 2,676,456; EP 285,123; EP 525,610; EP 368,341; and British Patent specification no. 1,296,839 (Novo). Examples of commercial α-amylases products are Termamyl®, Ban® and Fungamyl®, all available from Novo Nordisk A/S Denmark. WO95/26397 describes other suitable amylases: α-amylases characterised by having a specific activity at least 25% higher than the specific activity of Termamyl® at a temperature range of 25° C. to 55° C. and at a pH value in the range of 8 to 10, measured by the Phadebas® α-amylase activity assay. Other amylolytic enzymes with improved properties with respect to the activity level and the combination of thermostability and a higher activity level are described in WO95/35382.

The above-mentioned enzymes may be of any suitable origin, such as vegetable, animal, bacterial, fungal and yeast origin. Said enzymes are normally incorporated in the detergent composition at levels from 0.0001% to 2% of active enzyme by weight of the detergent composition. The enzymes can be added as separate single ingredients (prills, granulates, stabilized liquids, etc . . . containing one enzyme) or as mixtures of two or more enzymes (e.g. cogranulates).

Other suitable detergent ingredients that can be added are enzyme oxidation scavengers which are described in the copending European patent application 92870018.6 filed on Jan. 31, 1992. Examples of such enzyme oxidation scavengers are ethoxylated tetraethylene polyamines.

Color Care Benefits

Technologies which provide a type of color care benefit can also be included. Examples of these technologies are metallo catalysts for color maintenance. Such metallo catalysts are described in the European patent EP 0 596 184 and in the copending European Patent Application No. 94870206.3.

Bleaching Agent

Bleach systems that can be included in the detergent compositions of the present invention include bleaching agents such as PB1, PB4 and percarbonate with a particle size of 400–800 microns. These bleaching agent components can include one or more oxygen bleaching agents and, depending upon the bleaching agent chosen, one or more bleach activators. When present oxygen bleaching compounds will typically be present at levels of from about 1% to about 25%.

The bleaching agent component for use herein can be any of the bleaching agents useful for detergent compositions including oxygen bleaches as well as others known in the art.

The bleaching agent suitable for the present invention can be an activated or non-activated bleaching agent.

One category of oxygen bleaching agent that can be used encompasses percarboxylic acid bleaching agents and salts thereof. Suitable examples of this class of agents include magnesium monoperoxyphthalate hexahydrate, the magnesium salt of meta-chloro perbenzoic acid, 4-nonylamino-4-oxoperoxybytyric acid and diperoxydodecanedioic acid. Such bleaching agents are disclosed in U.S. Pat. No. 4,483,781, U.S. patent application Ser. No. 740,446, European Patent Application 0,133,354 and U.S. Pat. No. 4,412,934. Highly preferred bleaching agents also include 6-nonylamino-6-oxoperoxycaproic acid as described in U.S. Pat. No. 4,634,551.

Another category of bleaching agents that can be used encompasses the halogen bleaching agents. Examples of hypohalite bleaching agents, for example, include trichloro isocyanuric acid and the sodium and potassium dichloroisocyanurates and N-chloro and N-bromo alkane sulphonamides. Such materials are normally added at 0.5–10% by weight of the finished product, preferably 1–5% by weight.

The hydrogen peroxide releasing agents can be used in combination with bleach activators such as tetraacetylethylenediamine (TAED), nonanoyloxybenzenesulfonate (NOBS, described in U.S. Pat. No. 4,412,934), 3,5,-trimethylhexanoloxybenzenesulfonate (ISONOBS, described in EP 120,591) or pentaacetylglucose (PAG) or Phenolsulfonate ester of N-nonanoyl-6-aminocaproic acid (NACA-OBS, described in WO94/28106), which are perhydrolyzed to form a peracid as the active bleaching species, leading to improved bleaching effect. Also suitable activators are acylated citrate esters such as disclosed in Copending European Patent Application No. 91870207.7.

Useful bleaching agents, including peroxyacids and bleaching systems comprising bleach activators and peroxygen bleaching compounds for use in detergent compositions according to the invention are described in our co-pending applications U.S. Ser. No. 08/136,626, PCT/US95/07823, WO95/27772, WO95/27773, WO95/27774 and WO95/27775.

The hydrogen peroxide may also be present by adding an enzymatic system (i.e. an enzyme and a substrate therefore) which is capable of generating hydrogen peroxide at the beginning or during the washing and/or rinsing process. Such enzymatic systems are disclosed in EP Patent Application 912026556. filed Oct. 9, 1991.

Bleaching agents other than oxygen bleaching agents are also known in the art and can be utilized herein. One type of non-oxygen bleaching agent of particular interest includes photoactivated bleaching agents such as the sulfonated zinc and/or aluminum phthalocyanines. These materials can be deposited upon the substrate during the washing process. Upon irradiation with light, in the presence of oxygen, such as by hanging clothes out to dry in the daylight, the sulfonated zinc phthalocyanine is activated and, consequently, the substrate is bleached. Preferred zinc phthalocyanine and a photoactivated bleaching process are described in U.S. Pat. No. 4,033,718. Typically, detergent compositions will contain about 0.025% to about 1.25%, by weight, of sulfonated zinc phthalocyanine.

Builder System

The compositions according to the present invention may further comprise a builder system.

Any conventional builder system is suitable for use herein including aluminosilicate materials, silicates, polycarboxylates and fatty acids, materials such as ethylenediamine tetraacetate, diethylene triamine pentamethyleneacetate, metal ion sequestrants such as aminopolyphosphonates, particularly ethylenediamine tetramethylene phosphonic acid and diethylene triamine pentamethylenephosphonic acid. Phosphate builders as sodium tripolyphosphate can also be used herein.

Suitable builders can be an inorganic ion exchange material, commonly an inorganic hydrated aluminosilicate material, more particularly a hydrated synthetic zeolite such as hydrated zeolite A, X, B, HS or MAP.

Another suitable inorganic builder material is layered silicate, e.g. SKS-6 (Hoechst). SKS-6 is a crystalline layered silicate consisting of sodium silicate ($Na_2Si_2O_5$).

Suitable polycarboxylates containing one carboxy group include lactic acid, glycolic acid and ether derivatives thereof as disclosed in Belgian Patent Nos. 831,368, 821,369 and 821,370. Polycarboxylates containing two carboxy groups include the water-soluble salts of succinic acid, malonic acid, (ethylenedioxy) diacetic acid, maleic acid, diglycollic acid, tartaric acid, tartronic acid and fumaric acid, as well as the ether carboxylates described in German Offenlegenschrift 2,446,686, and 2,446,687 and U.S. Pat. No. 3,935,257 and the sulfinyl carboxylates described in Belgian Patent No. 840,623. Polycarboxylates containing three carboxy groups include, in particular, water-soluble citrates, aconitrates and citraconates as well as succinate derivatives such as the carboxymethyloxysuccinates described in British Patent No. 1,379,241, lactoxysuccinates described in Netherlands Application 7205873, and the oxypolycarboxylate materials such as 2-oxa-1,1,3-propane tricarboxylates described in British Patent No. 1,387,447.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,082,179, while polycarboxylates containing phosphone substituents are disclosed in British Patent No. 1,439,000.

Alicyclic and heterocyclic polycarboxylates include cyclopentane-cis,cis,cis-tetracarboxylates, cyclopentadienide pentacarboxylates, 2,3,4,5-tetrahydrofuran-cis, cis, cis-tetracarboxylates, 2,5-tetrahydrofuran-cis-dicarboxylates, 2,2,5,5-tetrahydrofuran-tetracarboxylates, 1,2,3,4,5,6-hexane-hexacar-boxylates and and carboxymethyl derivatives of polyhydric alcohols such as sorbitol, mannitol and xylitol. Aromatic polycarboxylates include mellitic acid, pyromellitic acid and the phthalic acid derivatives disclosed in British Patent No. 1,425,343.

Of the above, the preferred polycarboxylates are hydroxycarboxylates containing up to three carboxy groups per molecule, more particularly citrates.

Preferred builder systems for use in the present compositions include a mixture of a water-insoluble aluminosilicate builder such as zeolite A or of a layered silicate (SKS-6), and a water-soluble carboxylate chelating agent such as citric acid.

A suitable chelant for inclusion in the detergent compositions in accordance with the invention is ethylenediamine-N,N'-disuccinic acid (EDDS) or the alkali metal, alkaline earth metal, ammonium, or substituted ammonium salts thereof, or mixtures thereof. Preferred EDDS compounds are the free acid form and the sodium or magnesium salt thereof. Examples of such preferred sodium salts of EDDS include $Na_2$EDDS and $Na_4$EDDS. Examples of such preferred magnesium salts of EDDS include MgEDDS and $Mg_2$EDDS. The magnesium salts are the most preferred for inclusion in compositions in accordance with the invention.

Preferred builder systems include a mixture of a water-insoluble aluminosilicate builder such as zeolite A, and a watersoluble carboxylate chelating agent such as citric acid. Other builder materials that can form part of the builder system for use in granular compositions include inorganic materials such as alkali metal carbonates, bicarbonates, silicates, and organic materials such as the organic phosphonates, amino polyalkylene phosphonates and amino polycarboxylates.

Other suitable water-soluble organic salts are the homo- or co-polymeric acids or their salts, in which the polycarboxylic acid comprises at least two carboxyl radicals separated from each other by not more than two carbon atoms. Polymers of this type are disclosed in GB-A-1,596,756. Examples of such salts are polyacrylates of MW 2000–5000 and their copolymers with maleic anhydride, such copolymers having a molecular weight of from 20,000 to 70,000, especially about 40,000.

Detergency builder salts are normally included in amounts of from 10% to 80% by weight of the composition preferably from 20% to 70% and most usually from 30% to 60% by weight.

Suds Suppressor

Another optional ingredient is a suds suppressor, exemplified by silicones, and silica-silicone mixtures. Silicones can be generally represented by alkylated polysiloxane materials while silica is normally used in finely divided forms exemplified by silica aerogels and xerogels and hydrophobic silicas of various types. These materials can be incorporated as particulates in which the suds suppressor is advantageously releasably incorporated in a water-soluble or water-dispersible, substantially non-surface-active detergent impermeable carrier. Alternatively the suds suppressor can be dissolved or dispersed in a liquid carrier and applied by spraying on to one or more of the other components.

A preferred silicone suds controlling agent is disclosed in Bartollota et al. U.S. Pat. No. 3,933,672. Other particularly useful suds suppressors are the self-emulsifying silicone suds suppressors, described in German Patent Application DTOS 2 646 126 published Apr. 28, 1977. An example of such a compound is DC-544, commercially available from Dow Corning, which is a siloxane-glycol copolymer. Especially preferred suds controlling agent are the suds suppressor system comprising a mixture of silicone oils and 2-alkyl-alcanols. Suitable 2-alkyl-alkanols are 2-bytyl-octanol which are commercially available under the trade name Isofol 12 R.

Such suds suppressor system are described in Copending European Patent application N 92870174.7 filed Nov. 10, 1992.

Especially preferred silicone suds controlling agents are described in Copending European Patent application No. °92201649.8. Said compositions can comprise a silicone/silica mixture in combination with fumed nonporous silica such as Aerosil$^R$.

The suds suppressors described above are normally employed at levels of from 0.001% to 2% by weight of the composition, preferably from 0.01% to 1% by weight.

Others

Other components used in detergent compositions may be employed, such as soil-suspending agents, soil-release agents, optical brighteners, abrasives, bactericides, tarnish inhibitors, coloring agents, and/or encapsulated or non-encapsulated perfumes.

Especially suitable encapsulating materials are water soluble capsules which consist of a matrix of polysaccharide and polyhydroxy compounds such as described in GB 1,464,616.

Other suitable water soluble encapsulating materials comprise dextrins derived from ungelatinized starch acid-esters of substituted dicarboxylic acids such as described in U.S. Pat. No. 3,455,838. These acid-ester dextrins are, preferably, prepared from such starches as waxy maize, waxy sorghum, sago, tapioca and potato. Suitable examples of said encapsulating materials include N-Lok manufactured by National Starch. The N-Lok encapsulating material consists of a modified maize starch and glucose. The starch is modified by adding monofunctional substituted groups such as octenyl succinic acid anhydride.

Antiredeposition and soil suspension agents suitable herein include cellulose derivatives such as methylcellulose, carboxymethylcellulose and hydroxyethylcellulose, and homo- or co-polymeric polycarboxylic acids or their salts. Polymers of this type include the polyacrylates and maleic anhydride-acrylic acid copolymers previously mentioned as builders, as well as copolymers of maleic anhydride with ethylene, methylvinyl ether or methacrylic acid, the maleic anhydride constituting at least 20 mole percent of the copolymer. These materials are normally used at levels of from 0.5% to 10% by weight, more preferably from 0.75% to 8%, most preferably from 1% to 6% by weight of the composition.

Preferred optical brighteners are anionic in character, examples of which are disodium 4,4'-bis-(2-diethanolamino-4-anilino-s-triazin-6-ylamino)stilbene-2:2' disulphonate, disodium 4, -4'-bis-(2-morpholino-4-anilino-s-triazin-6-ylamino-stilbene-2:2'-disulphonate, disodium 4,4'-bis-(2,4-dianilino-s-triazin-6-ylamino)stilbene-2:2'-disulphonate, monosodium 4',4"-bis-(2,4-dianilino-s-tri-azin-6 ylamino) stilbene-2-sulphonate, disodium 4,4'-bis-(2-anilino-4-(N-methyl-N-2-hydroxyethylamino)-s-triazin-6-ylamino) stilbene-2,2'-disulphonate, di-sodium 4,4'-bis-(4-phenyl-2, 1,3-triazol-2-yl)-stilbene-2,2' disulphonate, di-so-dium 4,4'bis(2-anilino-4-(1-methyl-2-hydroxyethylamino)-s-triazin-6-ylami-no)stilbene-2,2'disulphonate, sodium 2(stilbyl-4"-(naphtho-1',2':4,5)-1,2,3-triazole-2"-sulphonate and 4,4'-bis(2-sulphostyryl)biphenyl. Highly preferred brighteners are the specific brighteners of copending European Patent application No. 95201943.8.

Other useful polymeric materials are the polyethylene glycols, particularly those of molecular weight 1000–10000, more particularly 2000 to 8000 and most preferably about 4000. These are used at levels of from 0.20% to 5% more preferably from 0.25% to 2.5% by weight. These polymers and the previously mentioned homo- or co-polymeric polycarboxylate salts are valuable for improving whiteness maintenance, fabric ash deposition, and cleaning performance on clay, proteinaceous and oxidizable soils in the presence of transition metal impurities.

Soil release agents useful in compositions of the present invention are conventionally copolymers or terpolymers of terephthalic acid with ethylene glycol and/or propylene glycol units in various arrangements. Examples of such polymers are disclosed in the commonly assigned U.S. Pat. Nos. 4,116,885 and 4,711,730 and European Published Patent Application No. 0 272 033. A particular preferred polymer in accordance with EP-A-0 272 033 has the formula $$(CH_3(PEG)_{43})_{0.75}(POH)_{0.25}[T\text{-}PO)_{2.8}(T\text{-}PEG)_{0.4}]T(PO\text{-}H)_{0.25}((PEG)_{43}CH_3)_{0.75}$$

where PEG is —$(OC_2H_4)O$—,PO is $(OC_3H_6O)$ and T is $(pcOC_6H_4CO)$.

Also very useful are modified polyesters as random copolymers of dimethyl terephthalate, dimethyl sulfoisophthalate, ethylene glycol and 1–2 propane diol, the end groups consisting primarily of sulphobenzoate and secondarily of mono esters of ethylene glycol and/or propane-diol. The target is to obtain a polymer capped at both end by sulphobenzoate groups, "primarily", in the present context most of said copolymers herein will be end-capped by sulphobenzoate groups. However, some copolymers will be less than fully capped, and therefore their end groups may consist of monoester of ethylene glycol and/or propane 1–2 diol, thereof consist "secondarily" of such species.

The selected polyesters herein contain about 46% by weight of dimethyl terephthalic acid, about 16% by weight of propane-1.2 diol, about 10% by weight ethylene glycol about 13% by weight of dimethyl sulfobenzoic acid and about 15% by weight of sulfoisophthalic acid, and have a molecular weight of about 3.000. The polyesters and their method of preparation are described in detail in EPA 311 342.

Is is well known in the art that free chlorine in tap water rapidly deactivates the enzymes comprised in detergent compositions. Therefore, using chlorine scavenger such as perborate, ammonium sulfate, sodium sulphite or polyethyleneimine at a level above 0.1% by weight of total composition, in the formulas will provide improved through the wash stability of the amylase enzymes. Compositions comprising chlorine scavenger are described in the European patent application 92870018.6 filed Jan. 31, 1992.

Softening Agents

Fabric softening agents can also be incorporated into laundry detergent compositions in accordance with the present invention. These agents may be inorganic or organic in type. Inorganic softening agents are exemplified by the smectite clays disclosed in GB-A-1 400 898 and in U.S. Pat. No. 5,019,292. Organic fabric softening agents include the water insoluble tertiary amines as disclosed in GB-A1 514 276 and EP-B0 011 340 and their combination with mono C12–C14 quaternary ammonium salts are disclosed in EP-B-0 026 527 and EP-B-0 026 528 and di-long-chain amides as disclosed in EP-B-0 242 919. Other useful organic ingredients of fabric softening systems include high molecular weight polyethylene oxide materials as disclosed in EP-A-0 299 575 and 0 313 146.

Levels of smectite clay are normally in the range from 2% to 20%, more preferably from 5% to 15% by weight, with the material being added as a dry mixed component to the remainder of the formulation. Organic fabric softening agents such as the water-insoluble tertiary amines or dilong chain amide materials are incorporated at levels of from 0.5% to 5% by weight, normally from 1% to 3% by weight whilst the high molecular weight polyethylene oxide materials and the water soluble cationic materials are added at levels of from 0.1% to 2%, normally from 0.15% to 1.5% by weight. These materials are normally added to the spray dried portion of the composition, although in some instances it may be more convenient to add them as a dry mixed particulate, or spray them as molten liquid on to other solid components of the composition.

Dye Transfer Inhibition

The detergent composition of the present invention can also include compounds for inhibiting dye transfer from one fabric to another of solubilized and suspended dyes encountered during fabric laundering operations involving colored fabrics.

Polymeric Dye Transfer Inhibiting Agents

The detergent compositions according to the present invention also comprise from 0.001% to 10%, preferably from 0.01% to 2%, more preferably from 0.05% to 1% by weight of polymeric dye transfer inhibiting agents. Said polymeric dye transfer inhibiting agents are normally incorporated into detergent compositions in order to inhibit the transfer of dyes from colored fabrics onto fabrics washed therewith. These polymers have the ability to complex or adsorb the fugitive dyes washed out of dyed fabrics before the dyes have the opportunity to become attached to other articles in the wash.

Especially suitable polymeric dye transfer inhibiting agents are polyamine N-oxide polymers, copolymers of N-vinylpyrrolidone and N-vinylimidazole, polyvinylpyrrolidone polymers, polyvinyloxazolidones and polyvinylimidazoles or mixtures thereof.

Addition of such polymers also enhances the performance of the enzymes according the invention.

a) Polyamine N-oxide Polymers

The polyamine N-oxide polymers suitable for use contain units having the following structure formula:

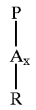

(I)

wherein P is a polymerisable unit, whereto the R—N—O group can be attached to or wherein the R—N—O group forms part of the polymerisable unit or a combination of both.

A is NC,

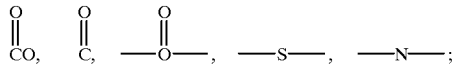

x is 0 or 1; R are aliphatic, ethoxylated aliphatics, aromatic, heterocyclic or alicyclic groups or any combination thereof whereto the nitrogen of the N—O group can be attached or wherein the nitrogen of the N—O group is part of these groups.

The N—O group can be represented by the following general structures:

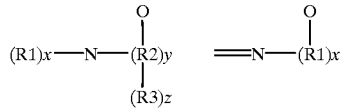

wherein R1, R2, and R3 are aliphatic groups, aromatic, heterocyclic or alicyclic groups or combinations thereof, x or/and y or/and z is 0 or 1 and wherein the nitrogen of the N—O group can be attached or wherein the nitrogen of the N—O group forms part of these groups.

The N—O group can be part of the polymerisable unit (P) or can be attached to the polymeric backbone or a combination of both.

Suitable polyamine N-oxides wherein the N—O group forms part of the polymerisable unit comprise polyamine N-oxides wherein R is selected from aliphatic, aromatic, alicyclic or heterocyclic groups.

One class of said polyamine N-oxides comprises the group of polyamine N-oxides wherein the nitrogen of the N—O group forms part of the R-group. Preferred polyamine N-oxides are those wherein R is a heterocyclic group such as pyrridine, pyrrole, imidazole, pyrrolidine, piperidine, quinoline, acridine and derivatives thereof.

Another class of said polyamine N-oxides comprises the group of polyamine N-oxides wherein the nitrogen of the N—O group is attached to the R-group.

Other suitable polyamine N-oxides are the polyamine oxides whereto the N—O group is attached to the polymerisable unit. Preferred class of these polyamine N-oxides are the polyamine N-oxides having the general formula (I) wherein R is an aromatic, heterocyclic or alicyclic groups wherein the nitrogen of the N—O functional group is part of said R group.

Examples of these classes are polyamine oxides wherein R is a heterocyclic compound such as pyrridine, pyrrole, imidazole and derivatives thereof.

Another preferred class of polyamine N-oxides are the polyamine oxides having the general formula (I) wherein R are aromatic, heterocyclic or alicyclic groups wherein the nitrogen of the N—O functional group is attached to said R groups.

Examples of these classes are polyamine oxides wherein R groups can be aromatic such as phenyl.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof.

The amine N-oxide polymers of the present invention typically have a ratio of amine to the amine N-oxide of 10:1 to 1:1000000. However the amount of amine oxide groups present in the polyamine oxide polymer can be varied by appropriate copolymerization or by appropriate degree of N-oxidation. Preferably, the ratio of amine to amine N-oxide is from 2:3 to 1:1000000. More preferably from 1:4 to 1:1000000, most preferably from 1:7 to 1:1000000. The polymers of the present invention actually encompass random or block copolymers where one monomer type is an amine N-oxide and the other monomer type is either an amine N-oxide or not. The amine oxide unit of the polyamine N-oxides has a PKa<10, preferably PKa<7, more preferred PKa<6.

The polyamine oxides can be obtained in almost any degree of polymerisation. The degree of polymerisation is not critical provided the material has the desired water-solubility and dye-suspending power.

Typically, the average molecular weight is within the range of 500 to 1000,000; preferably from 1,000 to 50,000, more preferably from 2,000 to 30,000, most preferably from 3,000 to 20,000.

b) Copolymers of N-vinylpyrrolidone and N-vinylimidazole

The N-vinylimidazole N-vinylpyrrolidone polymers used in the present invention have an average molecular weight range from 5,000–1,000,000, preferably from 5,000–200,000.

Highly preferred polymers for use in detergent compositions according to the present invention comprise a polymer selected from N-vinylimidazole N-vinylpyrrolidone copolymers wherein said polymer has an average molecular weight range from 5,000 to 50,000 more preferably from 8,000 to 30,000, most preferably from 10,000 to 20,000.

The average molecular weight range was determined by light scattering as described in Barth H. G. and Mays J. W. Chemical Analysis Vol 113, "Modern Methods of Polymer Characterization".

Highly preferred N-vinylimidazole N-vinylpyrrolidone copolymers have an average molecular weight range from 5,000 to 50,000; more preferably from 8,000 to 30,000; most preferably from 10,000 to 20,000.

The N-vinylimidazole N-vinylpyrrolidone copolymers characterized by having said average molecular weight range provide excellent dye transfer inhibiting properties while not adversely affecting the cleaning performance of detergent compositions formulated therewith.

The N-vinylimidazole N-vinylpyrrolidone copolymer of the present invention has a molar ratio of N-vinylimidazole to N-vinylpyrrolidone from 1 to 0.2, more preferably from 0.8 to 0.3, most preferably from 0.6 to 0.4.

c) Polyvinylpyrrolidone

The detergent compositions of the present invention may also utilize polyvinylpyrrolidone ("PVP") having an average molecular weight of from about 2,500 to about 400,000, preferably from about 5,000 to about 200,000, more preferably from about 5,000 to about 50,000, and most preferably from about 5,000 to about 15,000. Suitable polyvinylpyrrolidones are commercially available from ISP Corporation, New York, N.Y. and Montreal, Canada under the product names PVP K-15 (viscosity molecular weight of 10,000), PVP K-30 (average molecular weight of 40,000), PVP K-60 (average molecular weight of 160,000), and PVP K-90 (average molecular weight of 360,000). Other suitable polyvinylpyrrolidones which are commercially available from BASF Cooperation include Sokalan HP 165 and Sokalan HP 12; polyvinylpyrrolidones known to persons skilled in the detergent field (see for example EP-A-262,897 and EP-A-256,696).

d) Polyvinyloxazolidone:

The detergent compositions of the present invention may also utilize polyvinyloxazolidone as a polymeric dye transfer inhibiting agent. Said polyvinyloxazolidones have an average molecular weight of from about 2,500 to about 400,000, preferably from about 5,000 to about 200,000, more preferably from about 5,000 to about 50,000, and most preferably from about 5,000 to about 15,000.

e) Polyvinylimidazole:

The detergent compositions of the present invention may also utilize polyvinylimidazole as polymeric dye transfer inhibiting agent. Said polyvinylimidazoles have an average about 2,500 to about 400,000, preferably from about 5,000 to about 200,000, more preferably from about 5,000 to about 50,000, and most preferably from about 5,000 to about 15,000.

f) Cross-linked Polymers:

Cross-linked polymers are polymers whose backbone are interconnected to a certain degree; these links can be of chemical or physical nature, possibly with active groups n the backbone or on branches; cross-linked polymers have been described in the Journal of Polymer Science, volume 22, pages 1035–1039.

In one embodiment, the cross-linked polymers are made in such a way that they form a three-dimensional rigid structure, which can entrap dyes in the pores formed by the three-dimensional structure. In another embodiment, the cross-linked polymers entrap the dyes by swelling.

Such cross-linked polymers are described in the co-pending patent application 94870213.9.

Method of Washing

The compositions of the invention may be used in essentially any washing or cleaning methods, including soaking methods, pretreatment methods and methods with rinsing steps for which a separate rinse aid composition may be added.

The process described herein comprises contacting fabrics with a laundering solution in the usual manner and exemplified hereunder.

The process of the invention is conveniently carried out in the course of the cleaning process. The method of cleaning is preferably carried out at 5° C. to 95° C., especially between 10° C. and 60° C. The pH of the treatment solution is preferably from 7 to 11.

A preferred machine dishwashing method comprises treating soiled articles with an aqueous solution of the machine diswashing or rinsing composition. A conventional effective amount of the machine dishwashing composition means from 8–60 g of product dissolved or dispersed in a wash volume from 3–10 litres.

According to a manual dishwashing method, soiled dishes are contacted with an effective amount of the diswashing composition, typically from 0.5–20 g (per 25 dishes being treated). Preferred manual dishwashing methods include the application of a concentrated solution to the surfaces of the dishes or the soaking in large volume of dilute solution of the detergent composition.

The compositions of the invention may also be formulated as hard surface cleaner compositions.

The following examples are meant to exemplify compositions of the present invention, but are not necessarily meant to limit or otherwise define the scope of the invention.

In the detergent compositions, the level of the enzymes are expressed in pure enzyme by weight of total composition and the abbreviated component identifications have the following meanings:

| | |
|---|---|
| LAS | Sodium linear $C_{12}$ alkyl benzene sulphonate |
| TAS | Sodium tallow alkyl sulphate |
| XYAS | Sodium $C_{1X}$–$C_{1Y}$ alkyl sulfate |
| SAS | $C_{12}$–$C_{14}$ secondary (2, 3) alkyl sulfate in the form of the sodium salt. |
| AEC | Alkyl ethoxycarboxylate surfactant of formula $C_{12}$ ethoxy (2) carboxylate. |
| SS | Secondary soap surfactant of formula 2-butyl octanoic acid |
| 25EY | A $C_{12}$–$C_{15}$ predominantly linear primary alcohol condensed with an average of Y moles of ethylene oxide |
| 45EY | A $C_{14}$–$C_{15}$ predominantly linear primary alcohol condensed with an average of Y moles of ethylene oxide |
| XYEZS | $C_{1X}$–$C_{1Y}$ sodium alkyl sulfate condensed with an average of Z moles of ethylene oxide per mole |
| Nonionic | $C_{13}$–$C_{15}$ mixed ethoxylated/propoxylated fatty alcohol with an average degree of ethoxylation of 3.8 and an average degree of propoxylation of 4.5 sold under the tradename Plurafax LF404 by BASF Gmbh |
| CFAA | $C_{12}$–$C_{14}$ alkyl N-methyl glucamide |
| TFAA | $C_{16}$–$C_{18}$ alkyl N-methyl glucamide. |
| Silicate | Amorphous Sodium Silicate ($SiO_2$:$Na_2O$ ratio 2.0) |
| NaSKS-6 | Crystalline layered silicate of formula δ-$Na_2Si_2O_5$ |
| Carbonate | Anhydrous sodium carbonate |
| Metasilicate | Sodium metasilicate ($SiO_2$:$Na_2O$ ratio = 2.0) |
| STPP | Sodium tripolyphosphate |
| MA/AA | Copolymer of 1:4 maleic/acrylic acid, average molecular weight about 80,000 |
| PA30 | Polyacrylic acid of average molecular weight of approximately 8,000. |
| Terpolymer | Terpolymer of average molecular weight approx. 7,000, comprising acrylic:maleic:ethylacrylic acid monomer units at a weight ratio of 60:20:20. |
| 480N | Random copolymer of 3:7 acrylic/methacrylic acid, average molecular weight about 3,500. |
| Polyacrylate | Polyacrylate homopolymer with an average molecular weight of 8,000 sold under the tradename PA30 by BASF GmbH |
| Zeolite A | Hydrated Sodium Aluminosilicate of formula $Na_{12}(AlO_2SiO_2)_{12.\ 27H_2O}$ having a primary particle size in the range from 1 to 10 micrometers |
| Citrate | Tri-sodium citrate dihydrate |
| Citric | Citric Acid |
| PB1 | Anhydrous sodium perborate monohydrate bleach, empirical formula $NaBO_2.H_2O_2$ |
| PB4 | Anhydrous sodium perborate tetrahydrate |
| Percarbonate | Anhydrous sodium percarbonate bleach of empirical formula $2Na_2CO_3.3H_2O_2$ |
| TAED | Tetraacetyl ethylene diamine |
| NOBS | Nonanoyloxybenzene-sulfonate. |
| NACA-OBS | Phenolsulfonate ester of N-nonanoyl-6-aminocaproic acid. |
| Paraffin | Paraffin oil sold under the tradename Winog 70 by Wintershall. |
| Pectinase | Pectolytic enzyme sold under the tradename Pectinex AR by Novo Nordisk A/S. |
| Xylanase | Xylanolytic enzyme sold under the tradenames Pulpzyme HB or SP431 by Novo Nordisk A/S or Lyxasan (Gist-Brocades) or Optipulp or Xylanase (Solvay). |
| Protease | Proteolytic enzyme sold under the tradename Savinase, Alcalase, Durazym by Novo Nordisk A/S, Maxacal, Maxapem sold by Gist-Brocades and proteases described in patents WO91/06637 and/or WO95/10591 and/or EP 251 446. |
| Amylase | Amylolytic enzyme sold under the tradename Purafact Ox Am$^R$ described in WO 94/18314, sold by Genencor and those described in WO95/10603, available from Novo Nordisk A/S. |
| Lipase | Lipolytic enzyme sold under the tradename Lipolase, Lipolase Ultra by Novo Nordisk A/S |
| Peroxidase | Peroxidase enzyme |
| Cellulase | Cellulosic enzyme sold under the tradename Carezyme or Celluzyme by Novo Nordisk A/S. |
| CMC | Sodium carboxymethyl cellulose |
| HEDP | 1,1-hydroxyethane diphosphonic acid |
| DETPMP | Diethylene triamine penta (methylene phosphonic acid), marketed by Monsanto under the Trade name Dequest 2060. |
| PAAC | pentaamine acetate cobalt (III) sal. |
| BzP | Benzoyl peroxide. |
| PVP | Polyvinyl pyrrolidone polymer. |
| LSD | $C_{16}$–$C_{18}$ dimethyl amine oxide, $C_{12}$–$C_{18}$ alkyl ethoxysulfates ethoxylation degree 1–5, and the $C_{13}$–$C_{15}$ ethoxylated alcohols 12 or 30, sold under the trade names Lutensol A012 and Lutensol A030 respectively, by BASF GmbH. |
| SRP | Sulfonated poly-ethoxy/propoxy end capped ester oligomer and/or short block polymer synthetised from Dimethyl-terephtalate, 1,2 propylene Glycol, methyl capped PEG or sulfoethoxylate. |
| EDDS | Ethylenediamine -N, N'- disuccinic acid, [S,S] isomer in the form of the sodium salt. |
| Granular Suds Suppressor | 12% Silicone/silica, 18% stearyl alcohol,70% starch in granular form |
| SCS | Sodium cumene sulphonate |
| Sulphate | Anhydrous sodium sulphate. |
| HMWPEO | High molecular weight polyethylene oxide |

-continued

| | |
|---|---|
| PGMS | Polyglycerol monostearate having a tradename of Radiasurf 248 |
| TAE 25 | Tallow alcohol ethoxylate (25) |
| PEG(-6) | Polyethylene glycol (having a molecular weight of 600). |
| BTA | Benzotriazole |
| Bismuth nitrate | Bismuth nitrate salt |
| NaDCC | Sodium dichloroisocyanurate |
| KOH | 100% Active solution of Potassium Hydroxide |
| pH | Measured as a 1% solution in distilled water at 20° C. |

EXAMPLE 1

Granular fabric cleaning compositions in accord with the invention were prepared as follows:

| | I | II | III | IV | V |
|---|---|---|---|---|---|
| LAS | 22.0 | 22.0 | 22.0 | 22.0 | 22.0 |
| STPP | 23.0 | 23.0 | 23.0 | 23.0 | 23.0 |
| Carbonate | 23.0 | 23.0 | 23.0 | 23.0 | 23.0 |
| Silicate | 14.0 | 14.0 | 14.0 | 14.0 | 14.0 |
| Zeolite A | 8.2 | 8.2 | 8.2 | 8.2 | 8.2 |
| DETPMP | 0.4 | 0.4 | 0.4 | 0.4 | 0.4 |
| Sulfate | 5.5 | 5.5 | 5.5 | 5.5 | 5.5 |
| Amylase | 0.005 | 0.02 | 0.01 | 0.01 | 0.02 |
| Protease | 0.01 | 0.02 | 0.01 | 0.005 | 0.02 |
| Pectinase | 0.02 | — | — | — | — |
| Xylanase | — | — | 0.01 | 0.02 | — |
| Lipase | 0.005 | 0.01 | — | — | — |
| Cellulase | 0.001 | — | — | 0.001 | — |
| Water & minors | | | Up to 100% | | |

EXAMPLE 2

Granular fabric cleaning compositions in accord with the invention were prepared as follows:

| | I | II | III | IV | V |
|---|---|---|---|---|---|
| LAS | 12.0 | 12.0 | 12.0 | 12.0 | 12.0 |
| Zeolite A | 26.0 | 26.0 | 26.0 | 26.0 | 26.0 |
| SS | 4.0 | 4.0 | 4.0 | 4.0 | 4.0 |
| SAS | 5.0 | 5.0 | 5.0 | 5.0 | 5.0 |
| Citrate | 5.0 | 5.0 | 5.0 | 5.0 | 5.0 |
| SSulfate | 17.0 | 17.0 | 17.0 | 28.0 | 17.0 |
| PB1 | 16.0 | 16.0 | 16.0 | — | 16.0 |
| TAED | 5.0 | — | — | — | 5.0 |
| NOBS | — | 3.0 | — | — | — |
| NACA-OBS | — | — | 4.0 | — | 2.5 |
| Protease | 0.06 | 0.03 | 0.02 | 0.08 | 0.05 |
| Lipase | 0.005 | 0.01 | — | — | — |
| Amylase | 0.01 | 0.015 | 0.01 | 0.02 | 0.005 |
| Water & minors | | | Up to 100% | | |

EXAMPLE 3

Granular fabric cleaning compositions in accord with the invention which are especially useful in the laundering of coloured fabrics were prepared as follows:

| | I | II | III |
|---|---|---|---|
| LAS | 11.4 | 10.7 | — |
| TAS | 1.8 | 2.4 | — |
| TFAA | — | — | 4.0 |
| 45AS | 3.0 | 3.1 | 10.0 |
| 45E7 | 4.0 | 4.0 | — |
| 25E3S | — | — | 3.0 |
| 68E11 | 1.8 | 1.8 | — |
| 25E5 | — | — | 8.0 |
| Citrate | 14.0 | 15.0 | 7.0 |
| Carbonate | — | — | 10 |
| Citric | 3.0 | 2.5 | 3.0 |
| Zeolite A | 32.5 | 32.1 | 25.0 |
| Na–SKS-6 | — | — | 9.0 |
| MA/AA | 5.0 | 5.0 | 5.0 |
| DETPMP | 1.0 | 0.2 | 0.8 |
| Protease | 0.02 | 0.02 | 0.01 |
| Amylase | 0.03 | 0.03 | 0.005 |
| Silicate | 2.0 | 2.5 | — |
| Sulphate | 3.5 | 5.2 | 3.0 |
| PVP | 0.3 | 0.5 | — |
| Poly (4-vinylpyridine)-N-oxide/copolymer of vinyl-imidazole and vinyl-pyrrolidone | — | — | 0.2 |
| PB1 | 0.5 | 1.0 | — |
| Peroxidase | 0.01 | 0.01 | — |
| Phenol sulfonate | 0.1 | 0.2 | — |
| Water/Minors | | Up to 100% | |

EXAMPLE 4

Granular fabric cleaning compositions in accord with the invention were prepared as follows:

| | I | II | III | IV |
|---|---|---|---|---|
| LAS | 6.5 | 8.0 | 9.0 | 8.0 |
| 25AE3S | — | — | 1.0 | 1.0 |
| AS | 15.0 | 18.0 | 7.5 | 7.0 |
| 23E6.5 | — | — | 2.0 | 3.0 |
| Zeolite A | 26.0 | 22.0 | 24.0 | 28.0 |
| Sodium nitriloacetate | 5.0 | 5.0 | — | — |
| PVP | 0.5 | 0.7 | — | — |
| NOBS | — | — | 3.0 | — |
| DTPA | — | — | 0.3 | — |
| PB1 | 0.5 | 1.0 | 2.0 | 1.0 |
| Boric acid | 4.0 | — | — | — |
| Phenol sulfonate | 0.1 | 0.2 | — | — |
| PEG | — | — | 1.0 | 1.0 |
| Polyacrylate | — | — | 3.0 | 3.0 |
| Protease | 0.06 | 0.02 | 0.02 | 0.01 |
| Silicate | 5.0 | 5.0 | 1.0 | 1.0 |
| Carbonate | 15.0 | 15.0 | 15.0 | 30.0 |
| Peroxidase | 0.1 | 0.1 | — | — |
| Pectinase | 0.02 | — | — | — |
| Cellulase | 0.005 | 0.002 | 0.0005 | 0.002 |
| Lipase | 0.01 | — | 0.01 | — |
| Amylase | 0.01 | 0.01 | 0.01 | 0.01 |
| SRP | — | — | 0.2 | 0.2 |
| Sulfate | — | — | 19.5 | 6.5 |
| Water/minors | | Up to 100% | | |

EXAMPLE 5

A compact granular fabric cleaning composition in accord with the invention was prepared as follows:

| | | |
|---|---|---|
| LAS | — | 8.0 |
| TAS | — | 2.0 |
| 45AS | 8.0 | — |
| 25E3S | 2.0 | 0.5 |
| 25E5 | 3.0 | 5.0 |
| 25E3 | 3.0 | — |
| TFAA | 2.5 | — |
| Coco-alkyl-dimethyl hydroxy-ethyl ammonium chloride | — | 1.0 |
| Zeolite A | 17.0 | 15.0 |
| NaSKS-6 | 12.0 | 10.0 |
| Citric | 3.0 | 2.0 |
| Carbonate | 7.0 | 8.0 |
| MA/AA | 5.0 | 1.0 |
| CMC | 0.4 | 0.4 |
| Poly (4-vinylpyridine)-N-oxide/copolymer of vinylimidazole and vinylpyrrolidone | 0.2 | — |
| Protease | 0.05 | 0.03 |
| Lipase | 0.002 | 0.003 |
| Cellulase | 0.001 | 0.001 |
| Amylase | 0.01 | 0.006 |
| TAED | 6.0 | 3.0 |
| Percarbonate | 22.0 | 20.0 |
| NACA-OBS | — | 3.0 |
| EDDS | 0.3 | 0.2 |
| Granular suds suppressor | 3.5 | 3.0 |
| water/minors (sulfate) | Up to 100% | |

EXAMPLE 6

A granular fabric cleaning compositions in accord with the invention which provide "softening through the wash" capability were prepared as follows:

| | I | II |
|---|---|---|
| 45AS | — | 10.0 |
| LAS | 7.6 | — |
| 68AS | 1.3 | — |
| 45E7 | 4.0 | — |
| 25E3 | — | 5.0 |
| Coco-alkyl-dimethyl hydroxy-ethyl ammonium chloride | 1.4 | 1.0 |
| Citrate | 5.0 | 3.0 |
| Na–SKS-6 | — | 11.0 |
| Zeolite A | 15.0 | 15.0 |
| MA/AA | 4.0 | 4.0 |
| DETPMP | 0.4 | 0.4 |
| PB1 | 15.0 | — |
| Percarbonate | — | 15.0 |
| NACA-OBS | — | 2.0 |
| TAED | 5.0 | 5.0 |
| Smectite clay | 10.0 | 10.0 |
| HMWPEO | — | 0.1 |
| Protease | 0.02 | 0.01 |
| Lipase | 0.02 | 0.01 |
| Amylase | 0.03 | 0.005 |
| Cellulase | 0.001 | — |
| Silicate | 3.0 | 5.0 |
| Carbonate | 10.0 | 10.0 |
| Granular suds suppressor | 1.0 | 4.0 |
| CMC | 0.2 | 0.1 |
| Water/minors | Up to 100% | |

EXAMPLE 7

Heavy duty liquid fabric cleaning compositions suitable for use in the pretreatment of stained fabrics, and for use in a machine laundering method, in accord with the invention were prepared as follows:

| | I | II | III | IV | V |
|---|---|---|---|---|---|
| 24AS | 20.0 | 20.0 | 20.0 | 20.0 | 20.0 |
| SS | 5.0 | 5.0 | 5.0 | 5.0 | 5.0 |
| Citrate | 1.0 | 1.0 | 1.0 | 1.0 | 1.0 |
| $12E_3$ | 13.0 | 13.0 | 13.0 | 13.0 | 13.0 |
| Monoethanolamine | 2.5 | 2.5 | 2.5 | 2.5 | 2.5 |
| Protease | 0.005 | 0.03 | 0.02 | 0.04 | 0.01 |
| Lipase | 0.002 | 0.01 | 0.02 | — | 0.004 |
| Amylase | 0.005 | 0.005 | 0.001 | 0.01 | 0.004 |
| Cellulase | 0.04 | — | 0.01 | — | — |
| Pectinase | 0.02 | 0.02 | — | — | — |
| Water/propylene glycol/ethanol (100:1:1) | | | | | |

EXAMPLE 8

Heavy duty liquid fabric cleaning compositions in accord with the invention were prepared as follows:

| | I | II | III | IV |
|---|---|---|---|---|
| LAS acid form | — | — | 25.0 | — |
| $C_{12-14}$ alkenyl succinic acid | 3.0 | 8.0 | 10.0 | — |
| Citric acid | 10.0 | 15.0 | 2.0 | 2.0 |
| 25AS acid form | 8.0 | 8.0 | — | 15.0 |
| 25AE3S acid form | — | 3.0 | — | 4.0 |
| 25AE7 | — | 8.0 | — | 6.0 |
| 25AE3 | 8.0 | — | — | — |
| CFAA | — | — | — | 6.0 |
| DETPMP | 0.2 | — | 1.0 | 1.0 |
| Fatty acid | — | — | — | 10.0 |
| Oleic acid | 1.8 | — | 1.0 | — |
| Ethanol | 4.0 | 4.0 | 6.0 | 2.0 |
| Propanediol | 2.0 | 2.0 | 6.0 | 10.0 |
| Protease | 0.02 | 0.02 | 0.02 | 0.01 |
| Amylase | 0.005 | 0.01 | 0.005 | 0.01 |
| Coco-alkyl dimethyl hydroxy ethyl ammonium chloride | — | — | 3.0 | — |
| Smectite clay | — | — | 5.0 | — |
| PVP | 1.0 | 2.0 | — | — |
| Perborate | — | 1.0 | — | — |
| Phenol sulphonate | — | 0.2 | — | — |
| Peroxidase | — | 0.01 | — | — |
| NaOH | | Up to pH 7.5 | | |
| Waters/minors | | Up to 100% | | |

EXAMPLE 9

Heavy duty liquid fabric cleaning compositions in accord with the invention were prepared as follows:

| | I | II | III |
|---|---|---|---|
| Mono ethanol amine | 1.0 | 1.1 | 0.7 |
| C12HLAS | — | — | 9.6 |
| C25AE2.5S | 19.0 | 19.0 | 13.8 |
| Propane diol | 6.2 | 6.3 | 4.9 |
| 23E9 | 2.0 | 2.0 | 2.2 |
| Sodium toluene sulfonate | 2.5 | 2.8 | 1.5 |
| NaOH | 3.4 | 3.1 | 6.6 |
| Polyhydroxy fatty acid amide | 3.5 | 3.5 | — |
| Citric | 3.0 | 3.0 | 7.1 |
| Fatty acid | 2.0 | 2.0 | — |
| Amylase | 0.01 | 0.02 | 0.02 |
| Protease | 0.05 | 0.05 | 0.1 |
| Borax | 2.5 | 2.5 | 2.2 |

-continued

| | I | II | III |
|---|---|---|---|
| Ethanol | 3.4 | 3.4 | 1.9 |
| SRP | 0.2 | 0.1 | 0.3 |
| E15–18 ethoxylated tetraethylene pentaimine | 1.2 | 1.3 | 1.2 |
| Glycerine | — | — | 3.0 |
| Water & Minors | | Up to 100% | |

-continued

| | |
|---|---|
| Protease | 0.003 |
| Amylase | 0.001 |
| Cellulase | 0.001 |
| HCL | 0.12 |
| Antifoam agent | 0.019 |
| Blue dye | 80 ppm |
| $CaCl_2$ | 0.35 |
| Perfume | 0.90 |

EXAMPLE 10

The following liquid fabric cleaning compositions in accord with the present invention were prepared as follows:

| | I | II | III | IV | V | VI | VII | VIII |
|---|---|---|---|---|---|---|---|---|
| LAS | 10.0 | 13.0 | 9.0 | — | 25.0 | — | — | — |
| C25AS | 4.0 | 1.0 | 2.0 | 10.0 | — | 13.0 | 18.0 | 15.0 |
| C25E3S | 1.0 | — | — | 3.0 | — | 2.0 | 2.0 | 4.0 |
| C25E7 | 6.0 | 8.0 | 13.0 | 2.5 | — | — | 4.0 | 4.0 |
| TFAA | — | — | — | 4.5 | — | 6.0 | 8.0 | 8.0 |
| QAS | — | — | — | — | 3.0 | 1.0 | — | — |
| TPKFA | 2.0 | — | 13.0 | 2.0 | — | 15.0 | 7.0 | 7.0 |
| Rapeseed fatty acids | — | — | — | 5.0 | — | — | 4.0 | 4.0 |
| Citric | 2.0 | 3.0 | 1.0 | 1.5 | 1.0 | 1.0 | 1.0 | 1.0 |
| Dodecenyl/ tetradecenyl succinic acid | 12.0 | 10.0 | — | — | 15.0 | — | — | — |
| Oleic acid | 4.0 | 2.0 | 1.0 | — | 1.0 | — | — | — |
| Ethanol | 4.0 | 4.0 | 7.0 | 2.0 | 7.0 | 2.0 | 3.0 | 2.0 |
| 1,2 Propanediol | 4.0 | 4.0 | 2.0 | 7.0 | 6.0 | 8.0 | 10.0 | 13.- |
| Mono Ethanol Amine | — | — | — | 5.0 | — | — | 9.0 | 9.0 |
| Tri Ethanol Amine | — | — | 8 | — | — | — | — | — |
| NaOH (pH) | 8.0 | 8.0 | 7.6 | 7.7 | 8.0 | 7.5 | 8.0 | 8.2 |
| Ethoxylated tetraethylene pentamine | 0.5 | — | 0.5 | 0.2 | — | — | 0.4 | 0.3 |
| DETPMP | 1.0 | 1.0 | 0.5 | 1.0 | 2.0 | 1.2 | 1.0 | — |
| SRP 2 | 0.3 | — | 0.3 | 0.1 | — | — | 0.2 | 0.1 |
| PVNO | — | — | — | — | — | — | — | 0.10 |
| Protease | 0.2 | 0.01 | 0.05 | 0.02 | 0.5 | 0.05 | 0.06 | 0.01 |
| Lipase | — | .001 | — | .001 | — | — | .005 | .005 |
| Amylase | 0.02 | 0.02 | 0.06 | 0.05 | 0.05 | 0.01 | 0.06 | 0.03 |
| Cellulase | — | — | — | .015 | — | — | 0.02 | 0.05 |
| Boric acid | 0.1 | 0.2 | — | 2.0 | 1.0 | 1.5 | 2.5 | 2.5 |
| Na formate | — | — | 1.0 | — | — | — | — | — |
| Ca chloride | — | 0.015 | — | 0.01 | — | — | — | — |
| Bentonite clay | — | — | — | — | 4.0 | 4.0 | — | — |
| Suspending clay SD3 | — | — | — | — | 0.6 | 0.3 | — | — |
| Balance Moisture and Miscellaneous | 100 | 100 | 100 | 100 | 100 | 100 | 100 | 100 |

EXAMPLE 11

The following rinse added fabric softener composition, in accord with the invention, was prepared (parts by weight).

| | |
|---|---|
| Softener active | 24.5 |
| PGMS | 2.0 |
| AS | 3.5 |
| TAE 25 | 1.5 |

EXAMPLE 12

Syndet bar fabric cleaning compositions in accord with the invention were prepared as follows:

| | I | II | III |
|---|---|---|---|
| C12–16 AS | 20.0 | 20.0 | 20.0 |
| CFAA | 5.0 | 5.0 | 5.0 |
| LAS | 10.0 | 10.0 | 10.0 |
| Carbonate | 25.0 | 25.0 | 25.0 |
| Sodium pyrophosphate | 7.0 | 7.0 | 7.0 |
| STPP | 7.0 | 7.0 | 7.0 |
| Zeolite A | 5.0 | 5.0 | 5.0 |

-continued

| | I | II | III |
|---|---|---|---|
| CMC | 0.2 | 0.2 | 0.2 |
| Polyacrylate (MW 1400) | 0.2 | 0.2 | 0.2 |
| Coconut monoethanolamide | 5.0 | 5.0 | 5.0 |
| Amylase | 0.01 | 0.02 | 0.01 |
| Protease | 0.2 | 0.2 | 0.05 |
| Brightener, perfume | 0.2 | 0.2 | 0.2 |
| CaSO4 | 1.0 | 1.0 | 1.0 |
| MgSO4 | 1.0 | 1.0 | 1.0 |
| Water | 4.0 | 4.0 | 4.0 |
| Filler*: balance to 100% | | | |

*Can be selected from convenient materials such as CaCO3, talc, clay (Kaolinite, Smectite), silicates, and the like.

EXAMPLE 13

The following compact high density (0.96 Kg/L) dishwashing detergent compositions I to VI were prepared in accord with the invention:

| | I | II | III | IV | V | VI |
|---|---|---|---|---|---|---|
| STPP | — | — | 46.0 | 35.00 | — | — |
| Citrate | 32.95 | 17.05 | — | — | 17.05 | 25.00 |
| Carbonate | — | 17.50 | — | 18.0 | 15.00 | 25.00 |
| Silicate | 33.00 | 14.81 | 20.36 | 14.81 | 14.81 | — |
| Metasilicate | — | 2.50 | 2.50 | — | — | — |
| Percarbonate | 1.94 | 9.74 | 7.79 | 14.28 | 9.74 | 6.70 |
| PB4 | 8.56 | — | — | — | — | — |
| Alkyl sulfate | 3.00 | 3.00 | 3.00 | 3.00 | 3.00 | 3.00 |
| Nonionic | 1.50 | 2.00 | 1.50 | 1.50 | 2.00 | 2.60 |
| TAED | 4.78 | — | 2.39 | — | 2.00 | 4.00 |
| NOBS | — | 4.00 | — | — | — | 4.00 |
| NACA-OBS | — | — | 2.50 | — | — | |
| HEDP | 0.83 | 1.00 | 0.46 | — | 0.83 | — |
| DETPMP | 0.65 | 0.65 | — | — | — | — |
| PAAC | — | — | — | 0.20 | — | — |
| BzP | — | — | — | 4.44 | — | — |
| Paraffin | 0.50 | 0.50 | 0.50 | 0.50 | — | 0.20 |
| Protease | 0.075 | 0.05 | 0.10 | 0.10 | 0.08 | 0.01 |
| Lipase | — | — | 0.001 | 0.005 | 0.0004 | 0.001 |
| Amylase | 0.01 | 0.005 | 0.01 | 0.015 | 0.01 | 0.0025 |
| BTA | 0.30 | 0.30 | 0.30 | 0.30 | — | — |
| Bismuth Nitrate | — | 0.30 | — | — | — | — |
| PA30 | 4.02 | — | — | — | — | — |
| Terpolymer | — | — | — | 4.00 | — | — |
| 480N | — | 6.00 | 2.77 | — | 6.67 | |
| Sulphate | 5.00 | 17.00 | 3.00 | — | 23.00 | 1.00 |
| LSD | — | — | 2.50 | — | — | 10.0 |
| pH (1% solution) | 10.80 | 11.00 | 10.90 | 10.80 | 10.90 | 9.60 |
| Minors and water | Up to 100% | | | | | |

EXAMPLE 14

The following granular dishwashing detergent compositions examples I to IV of bulk density 1.02 Kg/L were prepared in accord with the invention:

| | I | II | III | IV | V | VI |
|---|---|---|---|---|---|---|
| STPP | 30.00 | 30.00 | 30.00 | 27.90 | 30.0 | 26.70 |
| Carbonate | 30.50 | 30.50 | 25.0 | 23.00 | 25.0 | 2.80 |
| Silicate | 7.40 | 7.40 | 7.40 | 12.00 | 8.00 | 20.34 |
| PB1 | 4.40 | 4.40 | 4.40 | — | 4.40 | — |

-continued

| | I | II | III | IV | V | VI |
|---|---|---|---|---|---|---|
| NaDCC | — | — | — | 2.00 | — | 1.50 |
| Alkyl sulfate | 1.0 | 1.0 | 1.0 | 2.0 | 2.0 | 1.5 |
| Nonionic | 0.75 | 0.75 | 0.75 | 1.90 | 1.20 | 0.50 |
| TAED | 1.00 | 1.00 | — | — | 1.00 | — |
| PAAC | — | — | 0.004 | — | — | — |
| BzP | — | 1.40 | — | — | — | — |
| Paraffin | 0.25 | 0.25 | 0.25 | — | — | — |
| Protease | 0.05 | 0.05 | 0.05 | 0.05 | 0.1 | 0.05 |
| lipase | 0.005 | 0.001 | — | — | 0.0008 | 0.001 |
| Amylase | 0.003 | 0.01 | 0.01 | 0.05 | 0.01 | 0.015 |
| BTA | 0.15 | — | 0.15 | — | — | — |
| Sulphate | 18.0 | 18.0 | 20.0 | 21.0 | 12.0 | — |
| LSD | — | — | 5.0 | — | 10.0 | — |
| pH (1% solution) | 10.80 | 10.80 | 10.80 | 10.70 | 10.70 | 12.30 |
| Minors and water | Up to 100% | | | | | |

EXAMPLE 15

The following detergent composition tablets of 25 g weight were prepared in accord with the present invention by compression of a granular dishwashing detergent composition at a pressure of 13KN/cm$^2$ using a standard 12 head rotary press:

| | I | II | III |
|---|---|---|---|
| STPP | — | 48.80 | 47.50 |
| Citrate | 26.40 | — | — |
| Carbonate | — | 5.00 | — |
| Silicate | 26.40 | 14.80 | 25.00 |
| Protease | 0.03 | 0.075 | 0.01 |
| Lipase | 0.005 | — | 0.0005 |
| Amylase | 0.01 | 0.005 | 0.001 |
| PB1 | 1.56 | 7.79 | — |
| PB4 | 6.92 | — | 11.40 |
| Alkyl sulfate | 2.00 | 3.00 | 2.00 |
| Nonionic | 1.20 | 2.00 | 1.10 |
| TAED | 4.33 | 2.39 | 0.80 |
| HEDP | 0.67 | — | — |
| DETPMP | 0.65 | — | — |
| Paraffin | 0.42 | 0.50 | — |
| BTA | 0.24 | 0.30 | — |
| PA30 | 3.2 | — | — |
| LSD | 10.0 | — | — |
| Sulphate | 10.0 | 10.5 | 3.20 |
| pH (1% solution) | 10.60 | 10.60 | 11.00 |
| Minors and water | Up to 100% | | |

EXAMPLE 16

The following liquid dishwashing detergent compositions in accord with the present invention I to II, of density 1.40 Kg/L were prepared:

| | I | II |
|---|---|---|
| STPP | 33.30 | 20.00 |
| Carbonate | 2.70 | 2.00 |
| Silicate | — | 4.40 |
| NaDCC | 1.10 | 1.15 |
| Alkyl sulfate | 3.00 | 1.50 |
| Nonionic | 2.50 | 1.00 |
| Paraffin | 2.20 | — |
| Protease | 0.03 | 0.02 |

-continued

| | I | II |
|---|---|---|
| Amylase | 0.01 | 0.02 |
| Lipase | — | 0.0025 |
| 480N | 0.50 | 4.00 |
| KOH | — | 6.00 |
| LSD | 2.0 | — |
| Sulphate | 1.60 | — |
| pH (1% solution) | 9.10 | 10.00 |
| Minors and water | Up to 100% | |

EXAMPLE 17

The following liquid hard surface cleaning compositions were prepared in accord with the present invention:

| | I | II | III | IV | V | VI |
|---|---|---|---|---|---|---|
| Amylase | 0.01 | 0.002 | 0.005 | 0.02 | 0.001 | 0.005 |
| Protease | 0.05 | 0.01 | 0.02 | 0.03 | 0.005 | 0.005 |
| EDTA* | — | — | 2.90 | 2.90 | — | — |
| Citrate | — | — | — | — | 2.90 | 2.90 |
| LAS | 1.95 | — | 1.95 | — | 1.95 | — |
| NiEO9 | 1.5 | 2.0 | 1.5 | 20. | 1.5 | 2.0 |
| NaC12 AS | — | 2.20 | — | 2.20 | — | 2.20 |
| NaC12 (ethoxy) **sulfate | — | 2.20 | — | 2.20 | — | 2.20 |
| C12 Dimethylamine oxide | — | 0.50 | — | 0.50 | — | 0.50 |
| SCS | 1.30 | — | 1.30 | — | 1.30 | — |
| Hexyl Carbitol** | 6.30 | 6.30 | 6.30 | 6.30 | 6.30 | 6.30 |
| Water | Balance to 100% | | | | | |

*Na4 ethylenediamine diacetic acid
**Diethylene glycol monohexyl ether
***All formulas adjusted to pH 7

EXAMPLE 18

The following spray composition for cleaning of hard surfaces and removing household mildew was prepared in accord with the present invention:

| | I |
|---|---|
| Amylase | 0.01 |
| Protease | 0.01 |
| Sodium octyl sulfate | 2.00 |
| Sodium dodecyl sulfate | 4.00 |
| NiEO9 | 2.00 |
| Sodium hydroxide | 0.80 |
| Silicate (Na) | 0.04 |
| Perfume | 0.35 |
| Water/minors | up to 100% |

What is claimed is:

1. A laundry detergent composition comprising:

A) an oxidative stability-enhanced amylase derived from *B. licheniformis* NCIB8061 as the W138Y variant;

B) a protease at a level of from 0.0001% to 0.5% pure protease enzyme by weight of total composition;

C) a color care agent selected from the group consisting of metallo catalysts and mixtures thereof;

and optionally D) a surfactant which is a member selected from the group consisting of the condensation products of ethylene oxide with a branched chain primary or secondary alcohol containing from about 8 to about 20 carbon atom.

* * * * *

UNITED STATES PATENT AND TRADEMARK OFFICE

CERTIFICATE OF CORRECTION

PATENT NO. : 6,140,293
DATED : October 31, 2000
INVENTOR(S) : Dimitris Lappas

It is certified that error appears in the above-identified patent and that said Letters Patent is hereby corrected as shown below:

Title page,
Foreign Application Priority Data, should read -- June 19, 1996 [EP] European Pat. Off.....96201705--.

Signed and Sealed this

Ninth Day of October, 2001

*Attest:*

Nicholas P. Godici

*Attesting Officer*

NICHOLAS P. GODICI
*Acting Director of the United States Patent and Trademark Office*